US006220731B1

(12) United States Patent
Ryan

(10) Patent No.: US 6,220,731 B1
(45) Date of Patent: Apr. 24, 2001

(54) CYCLORAMA LIGHT

(75) Inventor: John T. Ryan, Riverdale, NY (US)

(73) Assignee: Altman Stage Lighting Co., Inc., Yonkers, NY (US)

( * ) Notice: Subject to any disclaimer, the term of this patent is extended or adjusted under 35 U.S.C. 154(b) by 0 days.

(21) Appl. No.: 09/189,477

(22) Filed: Nov. 10, 1998

(51) Int. Cl.[7] ..... F21V 21/26

(52) U.S. Cl. ..... 362/373; 362/219; 362/217; 362/282; 362/284; 362/306; 362/319; 362/347; 362/293; 362/345; 362/368

(58) Field of Search ..... 362/219, 225, 362/217, 282, 284, 306, 319, 322, 324, 347, 293, 345, 373, 218, 368, 367, 404

(56) References Cited

U.S. PATENT DOCUMENTS

| | | | | |
|---|---|---|---|---|
| 963,912 | * | 7/1910 | Lyhne | 362/282 |
| 1,923,970 | * | 8/1933 | Dowling | 362/344 |
| 3,358,133 | * | 12/1967 | Thoman | 362/362 |
| 3,610,915 | * | 10/1971 | Moore | 362/282 |
| 3,686,495 | * | 8/1972 | Medley | 240/41.35 |
| 4,323,953 | * | 4/1982 | Hutchison | 362/226 |
| 4,439,816 | * | 3/1984 | Litchfield | 362/96 |
| 4,447,859 | * | 5/1984 | Racyznski | 362/319 |
| 4,985,815 | * | 1/1991 | Endo | 362/345 |
| 5,373,431 | * | 12/1994 | Hayman et al. | 362/364 |

* cited by examiner

*Primary Examiner*—Sandra O'Shea
*Assistant Examiner*—Ali Alavi
(74) *Attorney, Agent, or Firm*—Lackenbach Siegel Marzullo Aronson & Greenspan

(57) ABSTRACT

A cyclorama light includes a housing having generally opaque rear, bottom and side walls and an open front wall defining a window that extends from a region proximate to the upper end of the rear wall and a region proximate to the front end of the bottom wall and generally extending between the side walls. The housing defines a housing axis generally parallel to the rear and bottom walls and normal to the side walls. An elongate reflector essentially extends between the side walls and is mounted for rotary movements about the housing axis. An elongate lamp having a lamp axis is mounted on the reflector to maintain the lamp axis substantially coextensively with the housing axis, the reflector being configured to direct light generated by the elongate lamp with a predetermined intensity distribution through the window formed in the open front wall in a direction which is a function of the rotational position of the reflector about the housing axis. A filter is provided for covering the window with a color filter material, as well as an adjustment means for selectively adjusting the rotational position of the reflector about the housing axis. The direction of projection of the light emitted from the housing can thus be modified substantially independently of the specific orientation of the housing.

42 Claims, 19 Drawing Sheets

CYCLORAMA LIGHT

BACKGROUND OF THE INVENTION

1. Field of the Invention

The invention generally relates to luminaires and, more specifically, to an improved cyclorama light.

2. Description of the Prior Art

Large curved curtains or screens as backgrounds for stage settings have been used for many years. Such curtains or screens are frequently referred to as cycloramas ("CYCs"). Frequently such cycloramas also include a series of large pictures, as of a landscape, placed on a wall of a circular room so as to appear in natural perspective to a spectator standing on the set in the center. However, in the field of lighting, to which this invention relates, a cyclorama or a "CYC" is a vertical surface used to form the background for a theatrical setting, usually made of heavy cloth drawn tight to achieve a smooth flat surface. With appropriate light projected on it, it usually represents the sky or suggests limitless space. Traditionally, cycloramas were horizontally curved but may now also be flat or vertically curved as well. Examples of cycloramas are discussed generally in U.S. Pat. Nos. 3,989,362; 4,123,152; 4,512,117; and 4,893,447.

The present invention specifically relates to a cyclorama light or CYC light, which is a luminaire mounted at the top and/or the bottom of a cyclorama in order to light it in smooth, substantially uniform manner. While CYC lights have been known and have also been used for many years, they have had a number of disadvantages. In the past, CYC lights were difficult and inconvenient to work with in providing desired light distributions on a cyclorama. Aside from being bulky and heavy, known CYC lights have not always provided the desired light distributions or the necessary ranges to cover different cyclorama configurations. This was particularly true when the same CYC lights were used to provide lighting for both flat and curved screens. The adjustments required were difficult and inconvenient to make. Also, because such lights tended to emit significant amounts of light over relatively large areas, the lamps used for these lights tended to get very hot, thus also heating the luminaire itself Failure to adequately cool the bulbs has caused the lights themselves to become extremely hot as well as cause the deterioration of gel color filters used therein and even caused damage to the reflectors. Overheating of the lamp housings also presented danger of injury to the lighting staff as well as others in proximity to these lights.

Other disadvantages of prior CYC light included the inability of such lights to accommodate more than one size lamp or bulb. However, because there are a number of different lamp sizes, a standard lamp could not always be substituted and only the lamp for which the light was specifically designed could be used to replace a burned out lamp. Prior CYC lights have also had some difficulty in adjusting for non-level surfaces when these lamps are mounted on a floor or a stage. Lighting personnel have been required to use numerous objects that they placed under the light to adjust the angles of the light and the positions of shadow lines and/or to compensate for a non-level floor.

SUMMARY OF THE INVENTION

Accordingly, it is an object of the present invention to provide a CYC light that does not have the disadvantages inherent in such prior art lights.

It is another object of the present invention to provide a CYC light that includes an optically efficient reflector that provides desired substantially uniform light distribution over substantial set areas of cycloramas.

It is still another object of the present invention to provide CYC lights that can be readily and conveniently arranged in straight or curved banks to cover significant ranges and shapes of cyclorama sets.

It is yet another object of the present invention to provide a CYC light that can readily be adapted to illuminate flat as well as curved screens.

It is a further object of the present invention to provide a CYC light as in the previous objects which provides efficient cooling of both the bulb or lamp, reflector as well as the color filter materials, irrespective of whether the orientation of the light is for ground or sky CYC use.

It is still a further object of the present invention to provide a CYC light that can easily and quickly be converted between ground CYC and sky CYC applications.

It is yet a further object of the present invention to provide a CYC light which can accommodate a wide range of color filters, including flat glass and flexible gel filters.

It is still a further object of the present invention to provide a CYC light of the type under discussion which provides ease of focusing or adjustment in the shifting of the light concentration or distribution.

It is an additional object of the present invention to provide a CYC light that provides protection from damage to the bulb or lamp while optimizing the degree to which light is efficiently transmitted with minimal losses.

It is still an additional object of the present invention to provide a CYC light as in the above objects which can readily be modified to accept different sized bulbs or lamps.

It is a further additional object of the present invention to provide a CYC light that can readily be used both on level as well as non-level surfaces without compromising the desired directions of light projection.

In order to achieve the above objects, as well as others which will become evident hereinafter, a CYC light in accordance with the present invention comprises a housing having generally opaque rear, bottom and side walls and an open front wall defining a window extending from a region proximate to the upper end of said rear wall and a region proximate to the front end of said bottom wall and generally extending between said side walls. Said housing defining a housing axis generally parallel to said rear and bottom walls and normal to said side walls. An elongate reflector essentially extends between said side walls and mounted for rotary movements about said housing axis. An elongate lamp having a lamp axis is mounted on said reflector to maintain said lamp axis substantially coextensively with said housing axis. Said reflector is configured to direct light generated by said elongate lamp with a predetermined intensity distribution through said window formed in said open front wall in a direction which is a function of the rotational position of said reflector about said housing axis. Filter means is provided for covering said window with a color filter material. Adjustment means selectively adjusts the rotational position of said reflector about said housing axis. In this manner the direction of projection of the light emitted from said housing can be modified substantially independently of the specific orientation of said housing.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
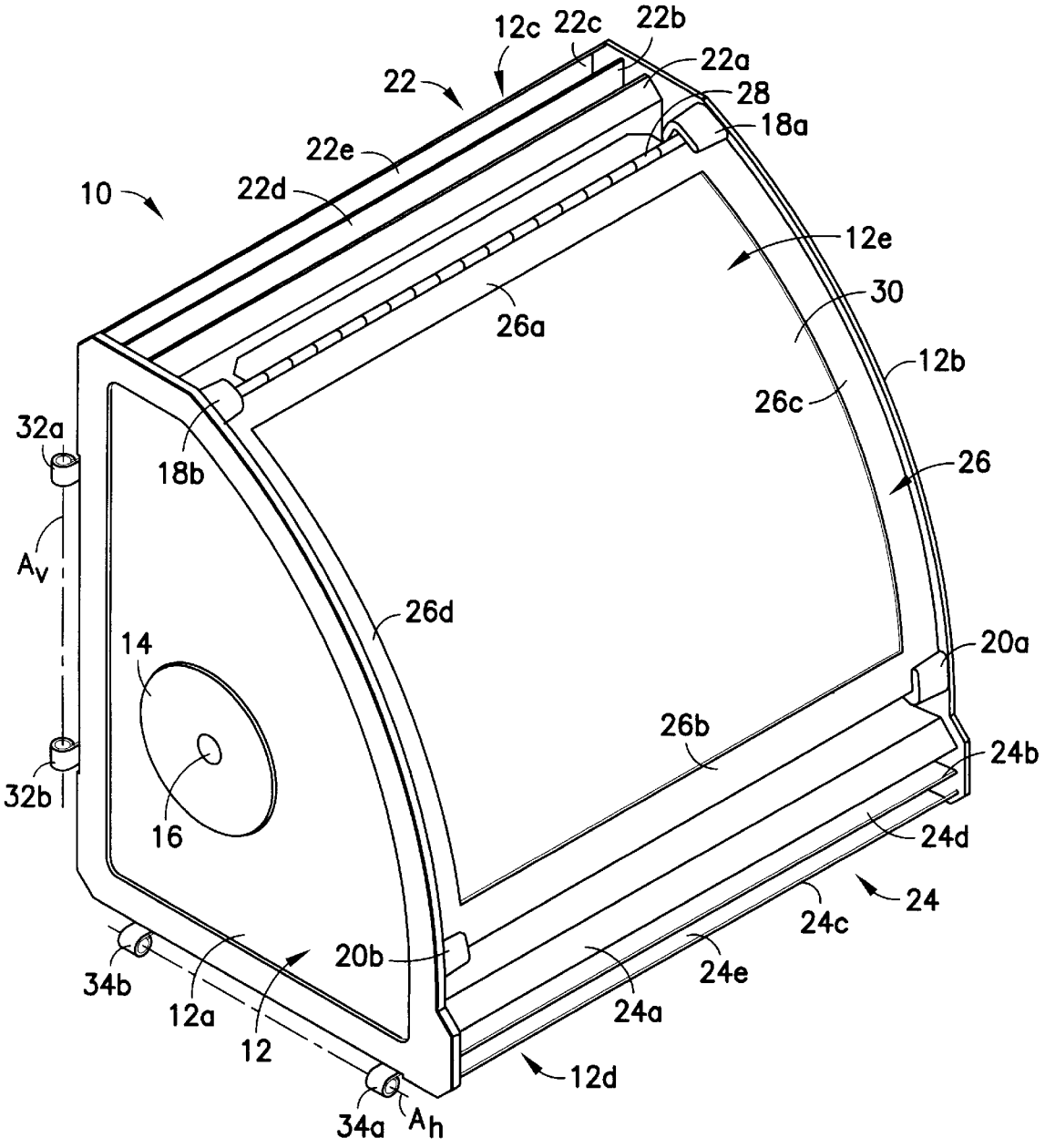
FIG. 1 is a perspective view of a CYC light in accordance with the present invention, illustrated positioned as a ground CYC placed on a floor or surface of a stage, with a flexible gel color filter material covering the opening in the CYC light through which light is emitted.
Figure 2:
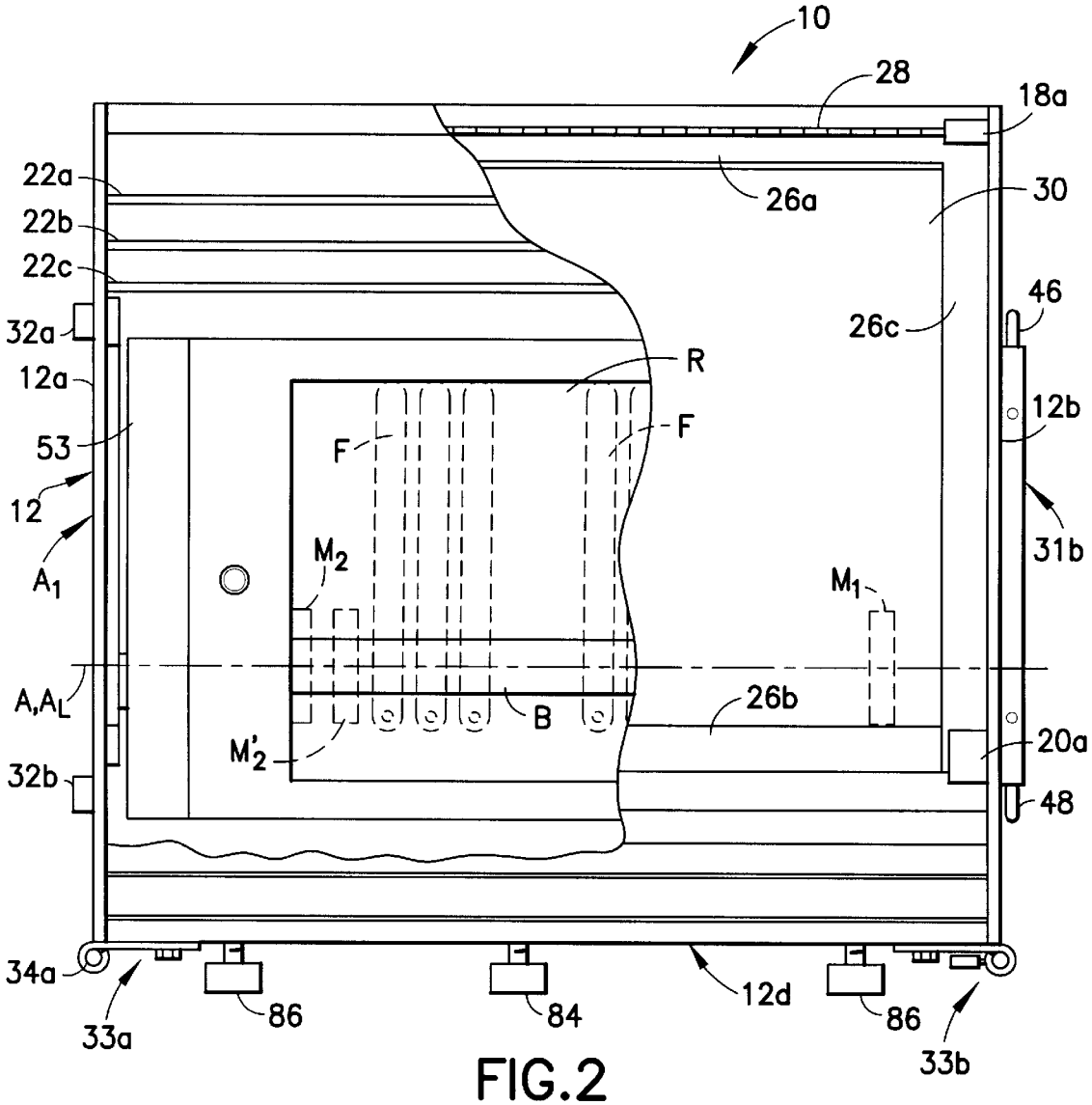
FIG. 2 is a front elevational view of the CYC light shown in FIG. 1, partially broken away to show the interior of the light to the rear of the color filter medium or material, including the lamp, reflector and reflector supporting frame.
Figure 3:
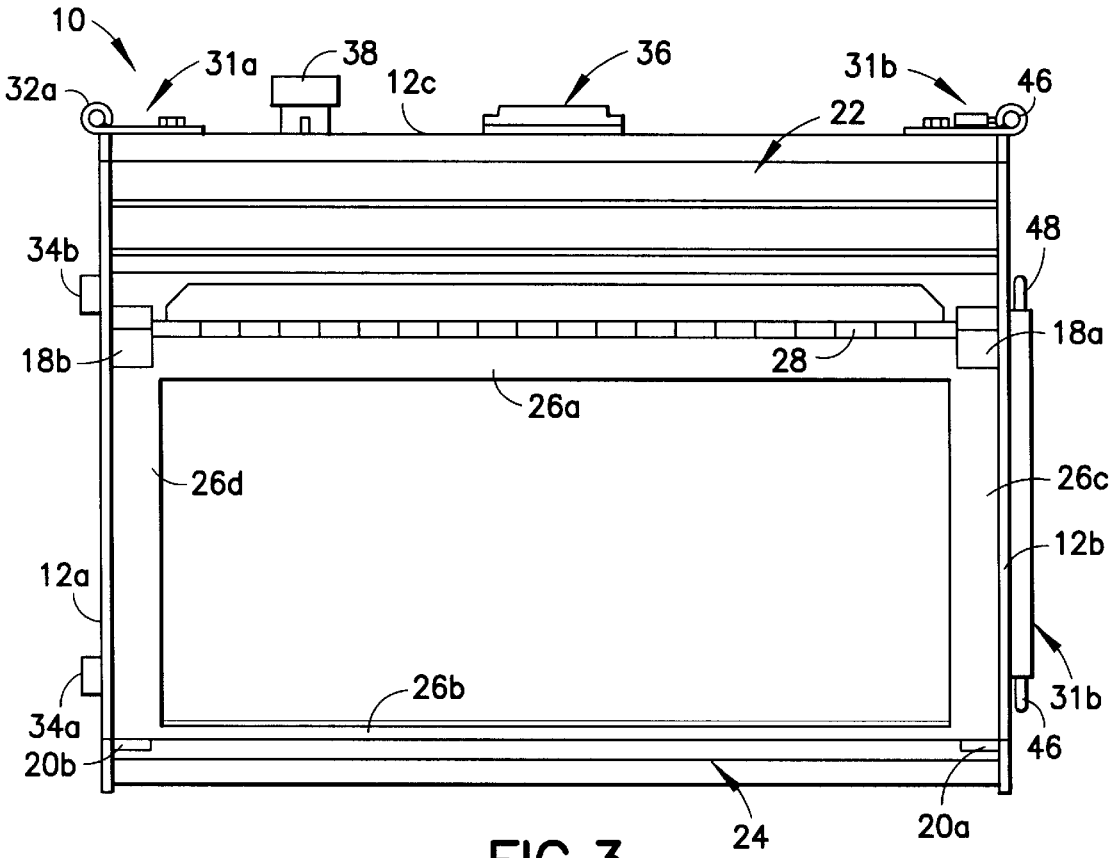
FIG. 3 is a top plan view of the light shown in FIGS. 1 and 2.
Figure 4:
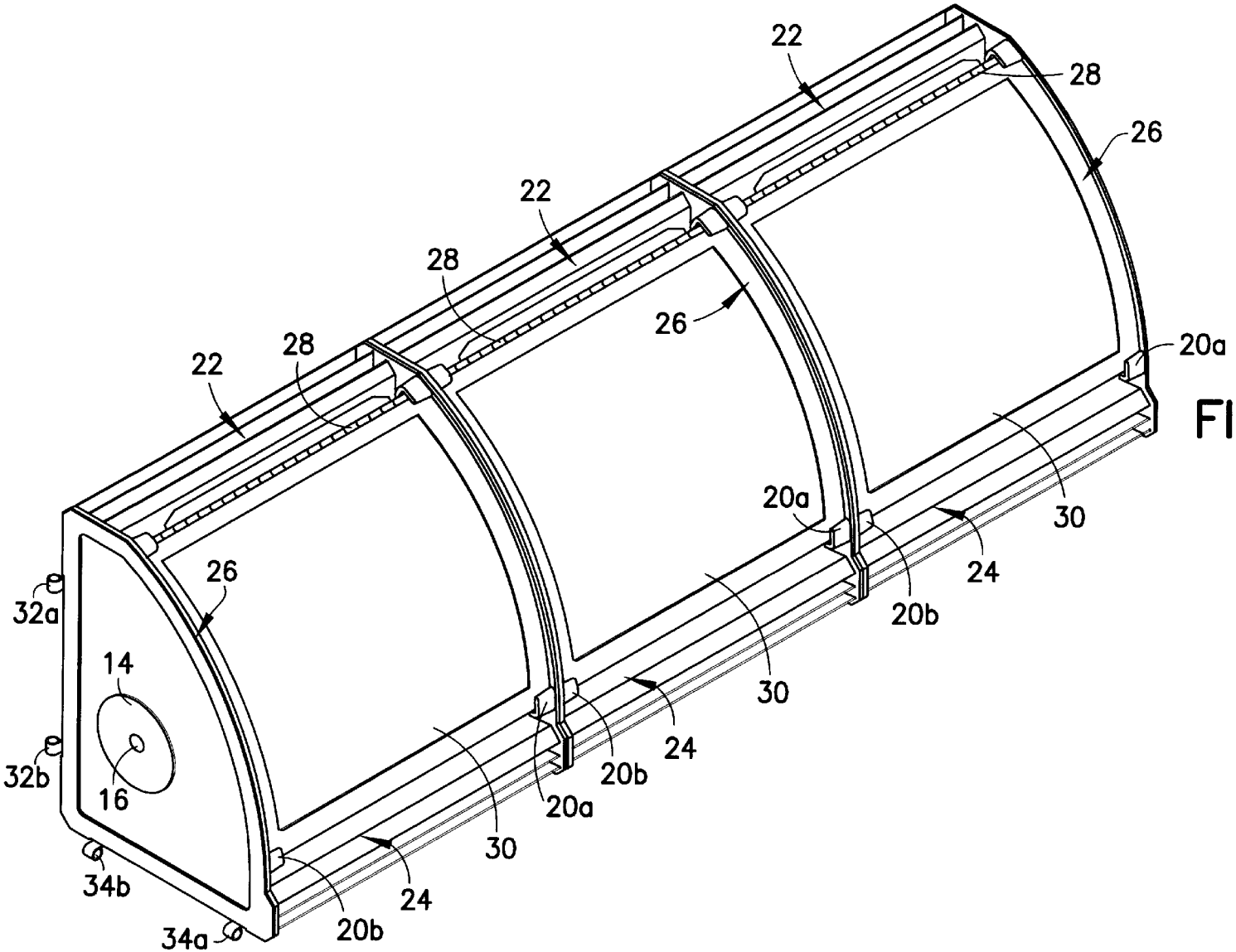
FIG. 4 is a perspective view of three CYC lights of the types shown in FIGS. 1–3 shown connected in tandem along a straight line to cover a greater range or larger area of a normally flat set.

Referring now specifically to the drawings, in which identical or similar parts are designated by the same reference numerals throughout, and first referring to FIGS. 1–3, a cyclorama or "CYC" light or luminaire in accordance with the present invention is generally designated by the reference numeral 10.

The light 10 includes a housing 12 having fixed side walls 12*a*, 12*b*, a fixed rear wall 12*c*, a fixed bottom wall 12*d* and a generally open front wall 12*e* which can be selectively closed or covered by a color filter, as will be more fully described below. The side walls 12*a*, 12*b* may be cast of thin metal and are each provided with a generally circular boss 14 as shown in FIG. 1 provided with a central threaded hole 16 for mounting the CYC light 10 in a sky CYC position as will be more fully described in connection with FIGS. 12–18. The housing 12 defines a tranverse axis A generally parallel to the rear and bottom walls 12*c*, 12*d* and normal to the side walls 12*a*, 12*b*.

Figure 8:
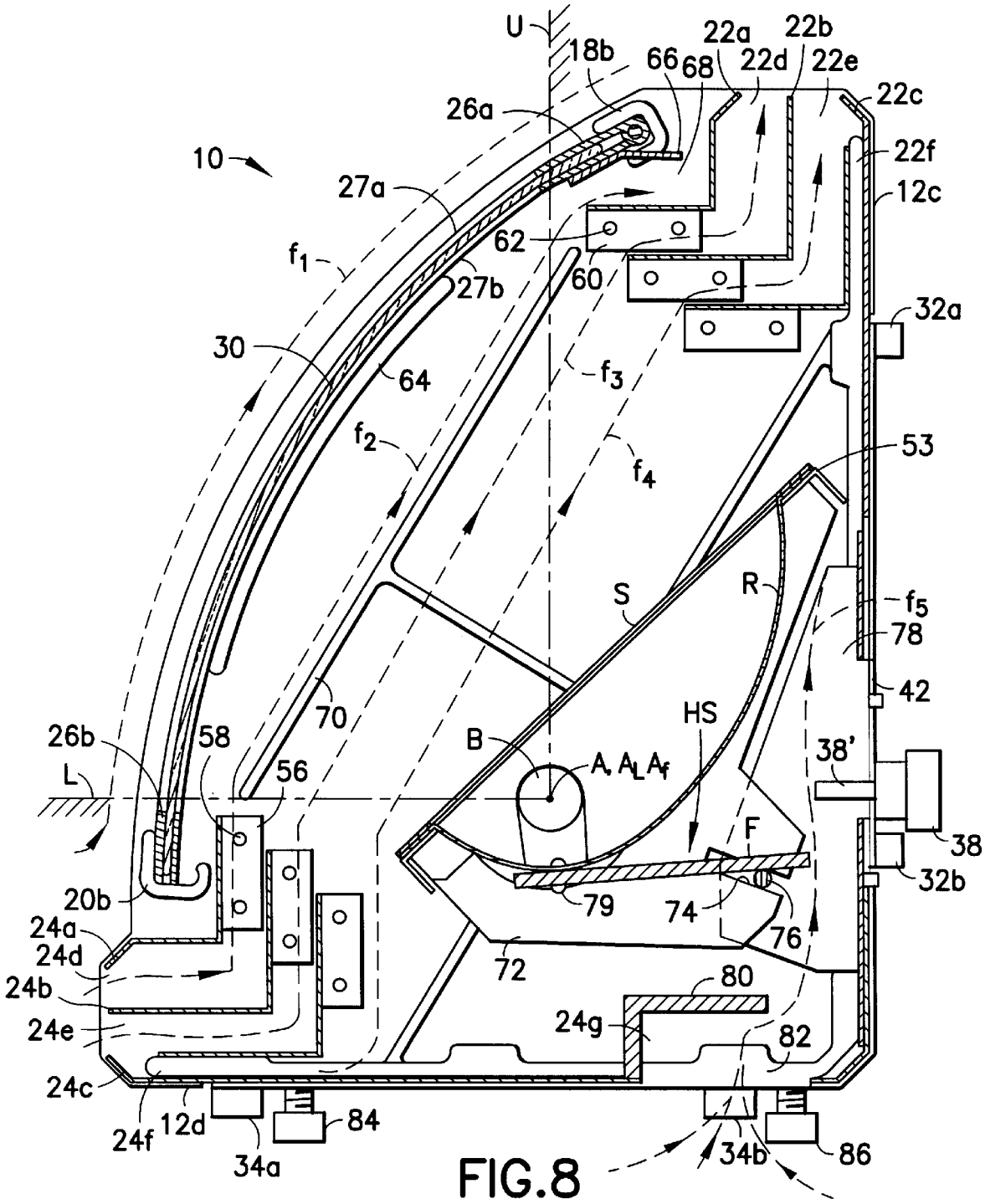
FIG. 8 is an enlarged cross sectional view of one of the CYC lights shown in FIG. 5 taken along line 8—8, shown with the reflector rotated in a fully clockwise direction to direct or focus the emitted light mostly in an upward direction.
Figure 9:
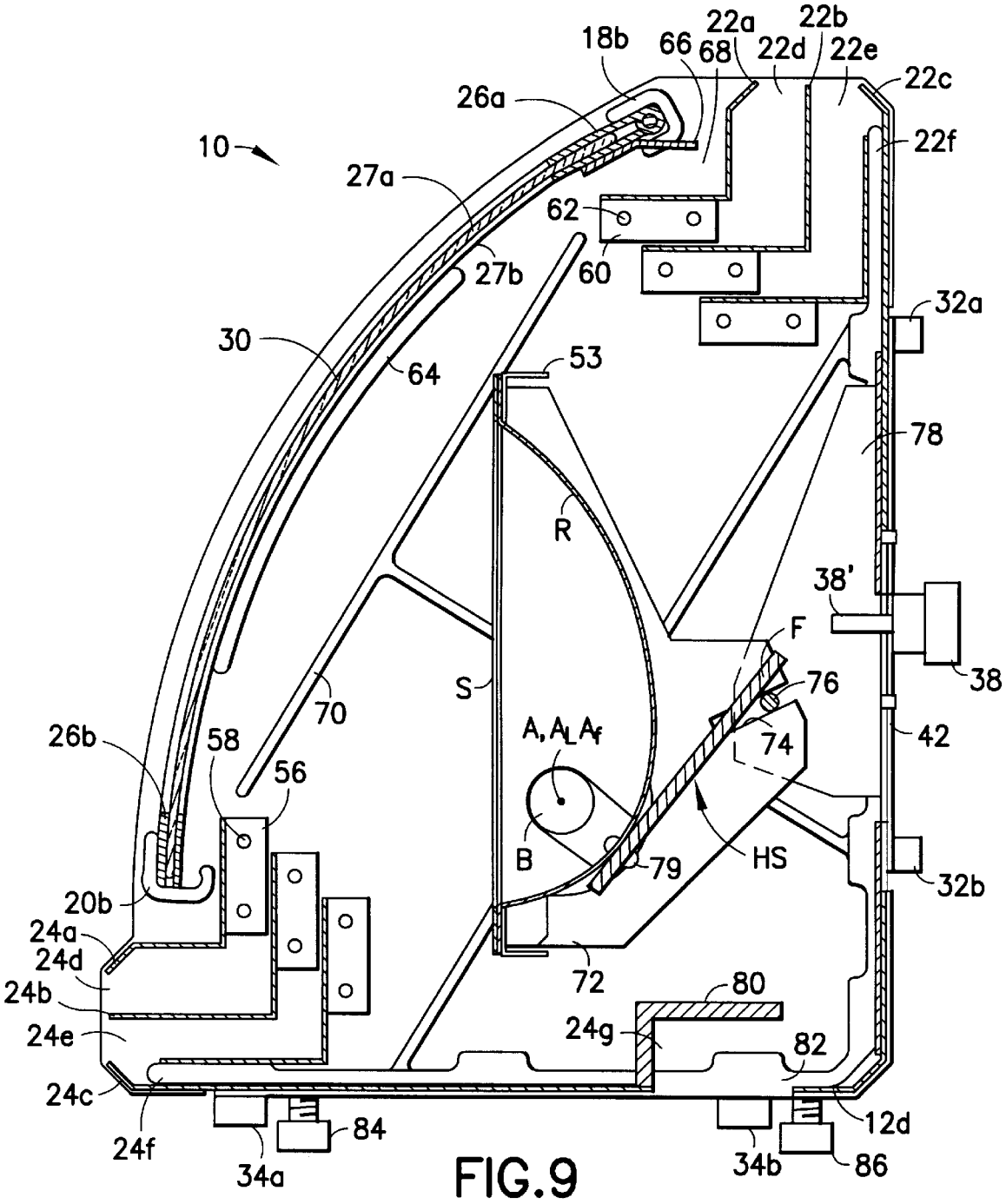
FIG. 9 is similar to FIG. 8 but showing the reflector rotated in a counterclockwise direction to move the concentration of the light more into a horizontal direction.
Figure 10:
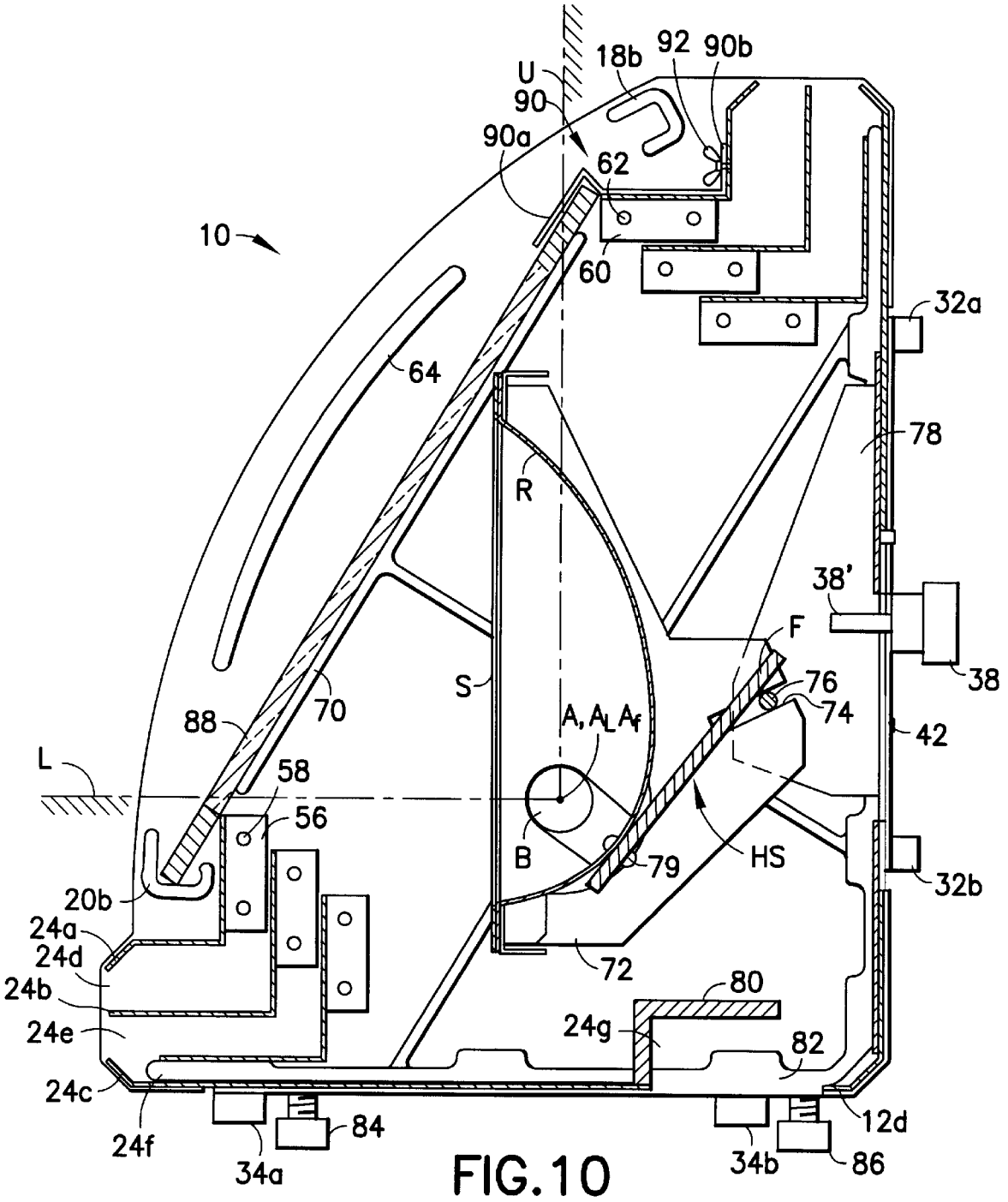
FIG. 10 is similar to FIGS. 8 and 9 but illustrating a glass color filter used in place of a flexible translucent plastic or gel sheet of color filter material.

Provided at the top of the front side or opening 12*e* are laterally spaced support or retaining fingers 18*a*, 18*b*, each of which is generally U-shaped as best shown, for example, in FIGS. 8–10. Similar lower U-shaped retaining fingers are shown at 20*a*, 20*b*. While the precise orientations of the upper and lower retaining fingers are not critical, the lower retaining fingers are shown open in the upper direction while the upper retaining fingers 18*a*, 18*b* are shown open in a direction inclined downwardly and forwardly at an angle of approximately 45° with the horizontal.

The upper retaining fingers 18*a*, 18*b* are shown spaced forwardly of the rear wall 12*c* to provide a generally open transverse region for receiving a plurality of upper baffles 22 extending between the side walls 12*a*, 12*b*. The upper baffles, as best shown in FIGS. 8–10, include a front baffle 22*a*, having an upper edge thereof bent rearwardly as shown, that cooperates with baffle plate 66 a straight, upwardly directed middle baffle 22*b* and a rear baffle 22*c* having its upper edge bent forwardly, as shown, to form channels 22*d* and 22*e*. An additional channel 22*f* is formed by the rear baffle 22*c* and the rear wall 12*c*. Lower baffles 24 are similar to the baffles 22. By bending the end baffles 22*a*, 22*c*, 24*a*, 24*c* inwardly, in relation to baffle 24*b* at the top and the bottom of the housing, it will be appreciated that Venturi-type conditions are established in channels 24*d*, 24*e*, 24*f* in which heated gases rise and are caused to flow from the channels formed by the lower baffles 24 through the housing 12 and out through the upper baffles 22, the Venturi effect creating low pressure conditions at the locations where the rising heated gases are forced to accelerate and move at a higher speed. Such regions of reduced pressures create dynamic conditions which enhance the flow of gases both interiorly and exteriorly of the housing, as indicated by broken lines $f_1$–$f_4$. It will also be appreciated that while the baffles 22 are normally the upper baffles and located at a point higher than the lower baffles 24, when the light 12 is used as a ground CYC, this condition reverses when the housing is rotated 180°, as suggested in FIG. 12, when the light is used as a sky CYC. When so re-oriented, the heated air within the housing causes the air flow to reverse in direction, although the same or similar conditions and benefits are obtained, as will be evident to those skilled in the art.

According to one feature of the invention, the front side 12*e* of the housing 12 can be covered with different color filters so that the white light generated by the internal bulb or lamp B can be projected in any desired color. According to one option, a flexible frame 26 is provided which consists of two similar thin flexible rectangular frames 27*a*, 27*b* connected to each other by means of a transverse hinge 28 about which the individual flexible frames may be pivoted relative to each other to separate the individual frames or bring them together as shown in FIG. 8. A flexible sheet of translucent plastic color filter material or gel 30 is placed between the peripheral borders of the frame 26 so as to be retained therein, when the frames 27*a*, 27*b* are brought together as shown. The frame 26 includes upper frame portions 26*a* and lower frame portions 26*b*, as well as side frame portions 26*c*, 26*d*. The individual frame portions define an opening or window through which light may be transmitted. The frame portions 26*a*–26*d* themselves are opaque and may be formed of thin sheet metal or other thin, flexible sheet material that can withstand relatively high temperatures created by the lamp B. Translucent plastic sheet materials or gels 30 are well known in the art and any such appropriate materials may be used in connection with the CYC light 10. The dimensions of the flexible frame 26 are selected such that the frame extends between the side walls 12*a*, 12*b* and extends from the lower U-shaped retaining fingers 20*a*, 20*b* to the upper U-shaped retaining fingers 18*a*, 18*b* when the frame is flexed as shown. The optional filter frame holder 26 is flexible and removable without the use of tools.

Figure 5:
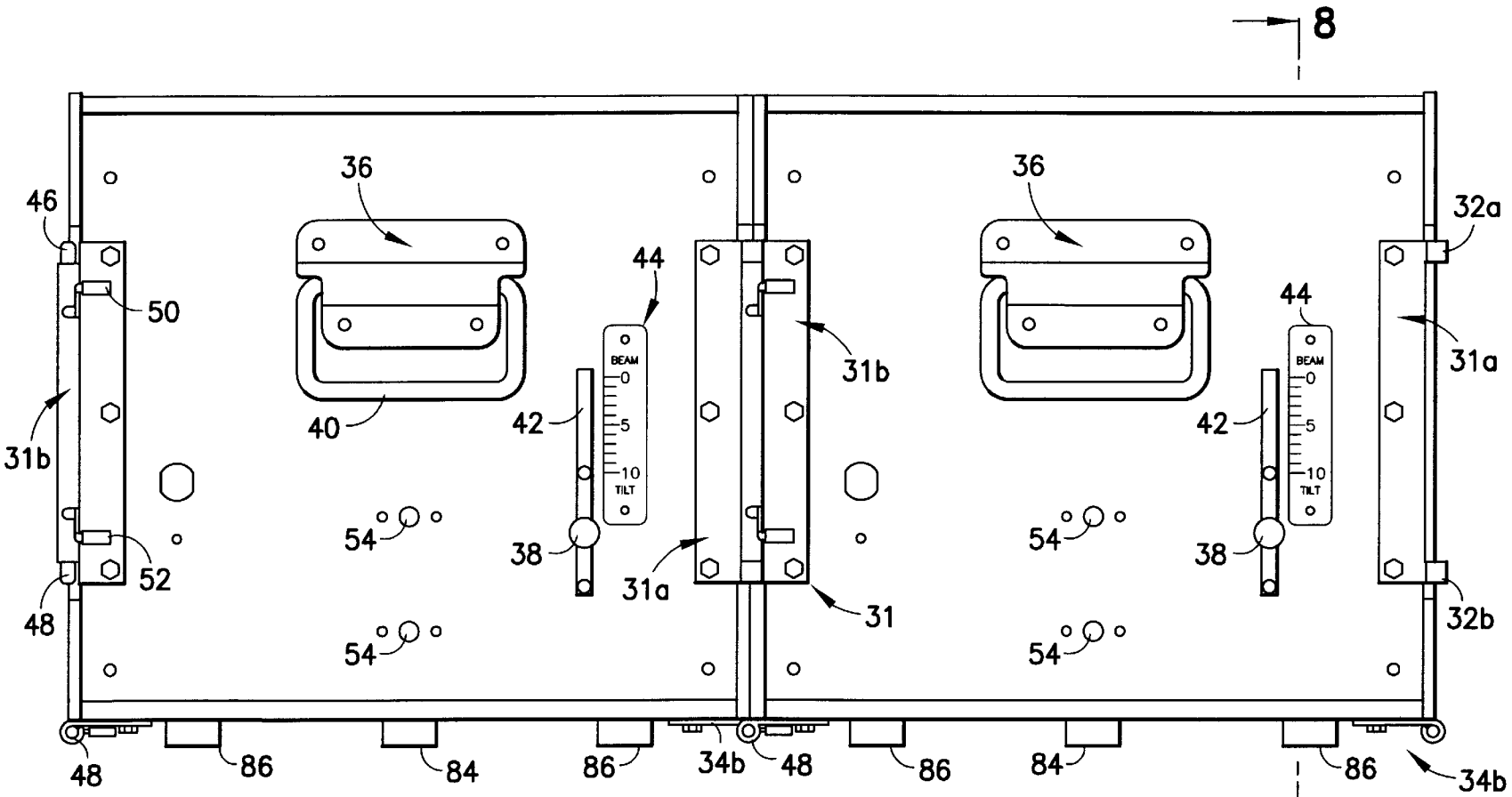
FIG. 5 is an enlarged rear elevational view of two of the connected CYC lights shown in FIG. 4.

Suitable quick release fasteners are provided at the corners of the rear of the housing 12, where the side walls 12*a*, 12*b* meet the rear wall 12*c*, as well as along the bottom of the housing where the side walls 12*a*, 12*b* meet the lower or bottom wall 12*d*. The fasteners at the rear and the bottom of the housing are configured to permit a plurality of CYC lights to be connected to each other in tandem along either or both of the rear and/or bottom walls. While the specific fasteners used are not critical, the presently preferred embodiment uses quick release spring loaded double bolt latches 31, 33 that make it possible to quickly and conveniently connect or disconnect adjacent housings 12 at the rear and bottom walls. Referring to FIG. 5, female latch members 31*a* include spaced female loops or sleeves 32*a*, 32*b* that may be suitably secured along one of the rear edges while male latch members 31*b* include spring loaded pins 46, 48 that may be inwardly moved by means of grip levers 50, 52. It will be evident that by squeezing the grip levers 50, 52 together towards each other the male spring loaded pins 46, 48 are moved inwardly toward each other so as to clear the female loops 32*a*, 32*b*. Once the pins are aligned with the loops 32*a*, 32*b* the grips may be released and the spring loaded catch pins are able to be received within the associated loops. Such a connection is shown in FIG. 5. To separate two adjoining housings the grip levers 50, 52 may again be squeezed toward each other so as to allow the male catches or pins 46, 48 to be withdrawn from the associated sleeves 32*a*, 32*b* and ultimately separated or disconnected. Similar latches 34, including female latch members 33*a* having loops 34*a*, 34*b* and male latch members 33*b*, are preferably provided in the regions where the sidewalls are proximate to the bottom walls. The use of rugged, tool-free quick release spring latches allows multiple units to be safely locked together in a number of different ways, such as in a straight row, curved horizontally, curved vertically, or any combination of the three.

Preferably, provided on the rear walls 12*c* are handle retaining brackets 36 that retain handles 40 that may be moved to a position along the back wall 12*c* as shown, when not being used, or may be rotated 90° upwardly, as viewed in FIG. 5, to provide a handle suitable for picking up the light. The rear mounted handles 40 can also serve as an attachment for a safety cable, when the CYC lights are sky mounted.

Referring to FIGS. 5 and 8, an adjustment knob 38 is shown that includes a pin or shaft 38' (FIG. 8) extending through and movable within a slot 42 along a direction extending between the bottom wall 12*d* and the upper baffles 22. A graduated scale 44 may be provided proximate to the slot 42 to provide a relative or reference reading for the position of the interior reflector R.

Figure 2A:
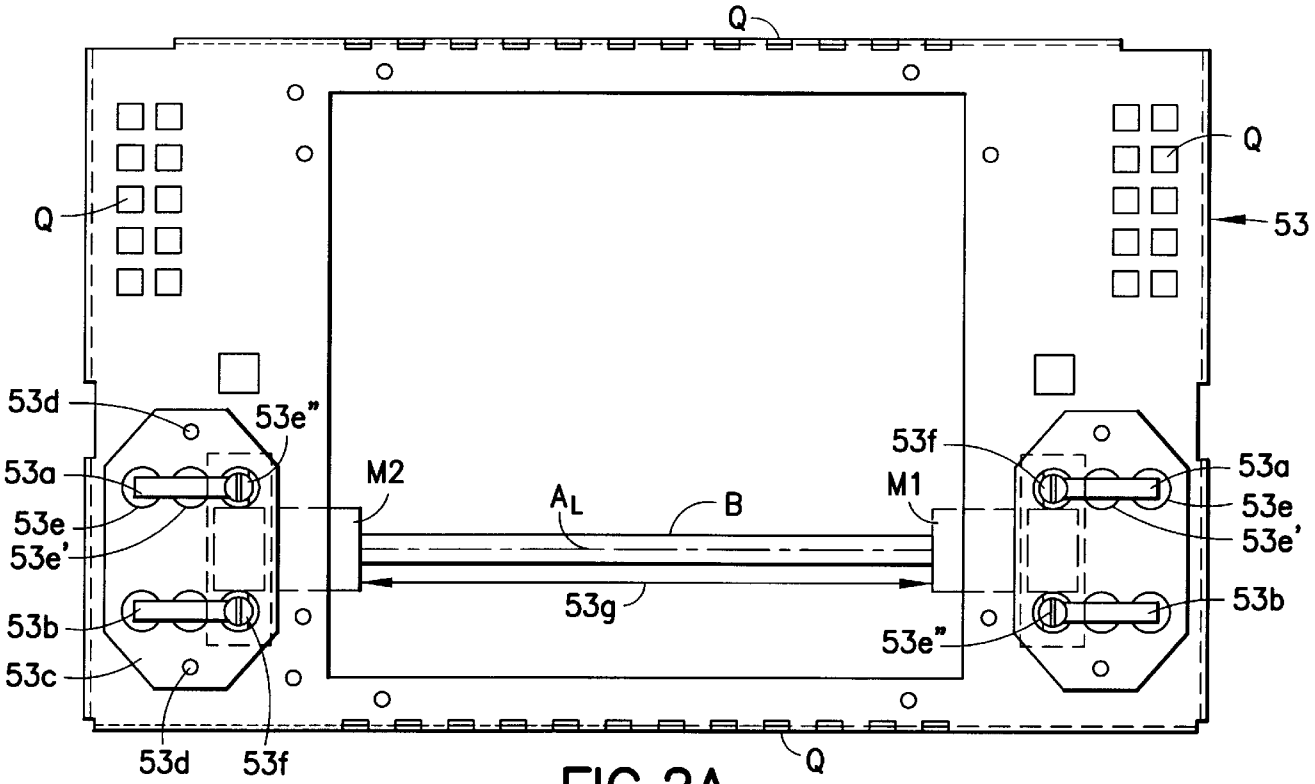
FIG. 2A is a front elevational view of the reflector supporting frame, showing the details of the adjustment mechanism fr adjusting for different length bulbs.
Figure 2B:
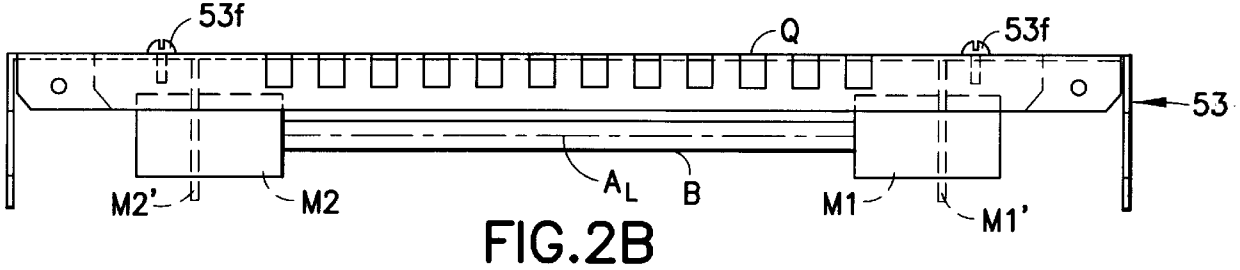
FIG. 2B is a bottom plan view of the frame shown in FIG. 2A.

As indicated in FIG. 2, provided within the housing 12 is a reflector frame 53 that defines a plane generally parallel to the housing axis A and essentially extends between the side walls 12*a*, 12*b*. Frame 53 is rotatably mounted on the side walls 12*a*, 12*b* about the housing axis A and supports a reflector R extending rearwardly of the frame 53. As best illustrated in FIGS. 2, 2A and 2B,the frame 53 includes mounting sockets $M_1$, $M_2$ spaced from each other along the axis A for holding a bulb or a lamp B, with the lamp axis $A_L$ being substantially coextensive with the housing axis A. By mounting at least one of the light sockets $M_1$, $M_2$ for slidable movement along the direction of the lamp axis $A_L$ (e.g., to $M_2'$ in FIG. 2), different lamps, such as T-2 to T-8 lamps, may be used by making a simple adjustment.

Referring to FIGS. 2A and 2B, a specific construction is shown, by way of example only, for providing the adjustability of the socket $M_1$, $M_2$ positions. Two slots 53*a*, 53*b* are provided on opposing lateral sides of the frame 53, the slots being parallel to and arranged on opposite sides of the lamp axis $A_L$. It will be evident, however, that a greater or lesser number of slots may be provided as long as one slot is provided. A detent plate 53*c* is secured to the frame 53 by any suitable means, such as rivets 53*d*, to align a plurality of connected screw receiving openings 53*e*, 53*e*' and 53*e*" as shown. A right angle bracket $M_1'$ supports socket $M_1$ and can be secured to the frame 53 by means of a screw 53*f* which is selectively positionable in one of the openings 53*e*, 53*e*' or 53*e*". Bracket M2' similar supports socket M2, so that a number of combinations of positions of the brackets can change distance 53*g*.

The frame 53 may be provided with additional apertures Q to allow for greater air flow and cooling of the lamp B and the reflector R.

The reflector R is mounted on the frame 53 for rotation about the axis A in any suitable or conventional manner. As best shown in FIGS. 8–10, a follower plate 72 is attached to the frame 53 that has a slot 74, as shown, dimensioned to receive a linkage pin 76. The linkage pin 76 is mounted on a tilt adjustment bracket 78 that is movable along the rear wall 12*c*, it being clear that upwardly directed movements of the bracket 78, as viewed in FIG. 8, will cause the frame 53 and reflector R to rotate in a counterclockwise direction as a result of the correspondingly upward movement of the linkage pin 76, while downward movements of the bracket 78 will result in corresponding downward movements of the linkage pin 76 and cause the frame 53 and reflector R to rotate in a clockwise direction. Once a suitable position has been selected for the reflector R, so that the light flux is adequately focused or positioned, the knob 38 can be tightened or locked to prevent inadvertent further upward or downward movements of the knob 38 and therefore of the adjustment bracket 78. Mounted proximate to the reflector R along the axis A is the lamp or bulb B preferably mounted at a location within the reflector that will optimally produce the desired lighting conditions, as to be more fully discussed in connection with FIG. 2A.

Figure 2C:
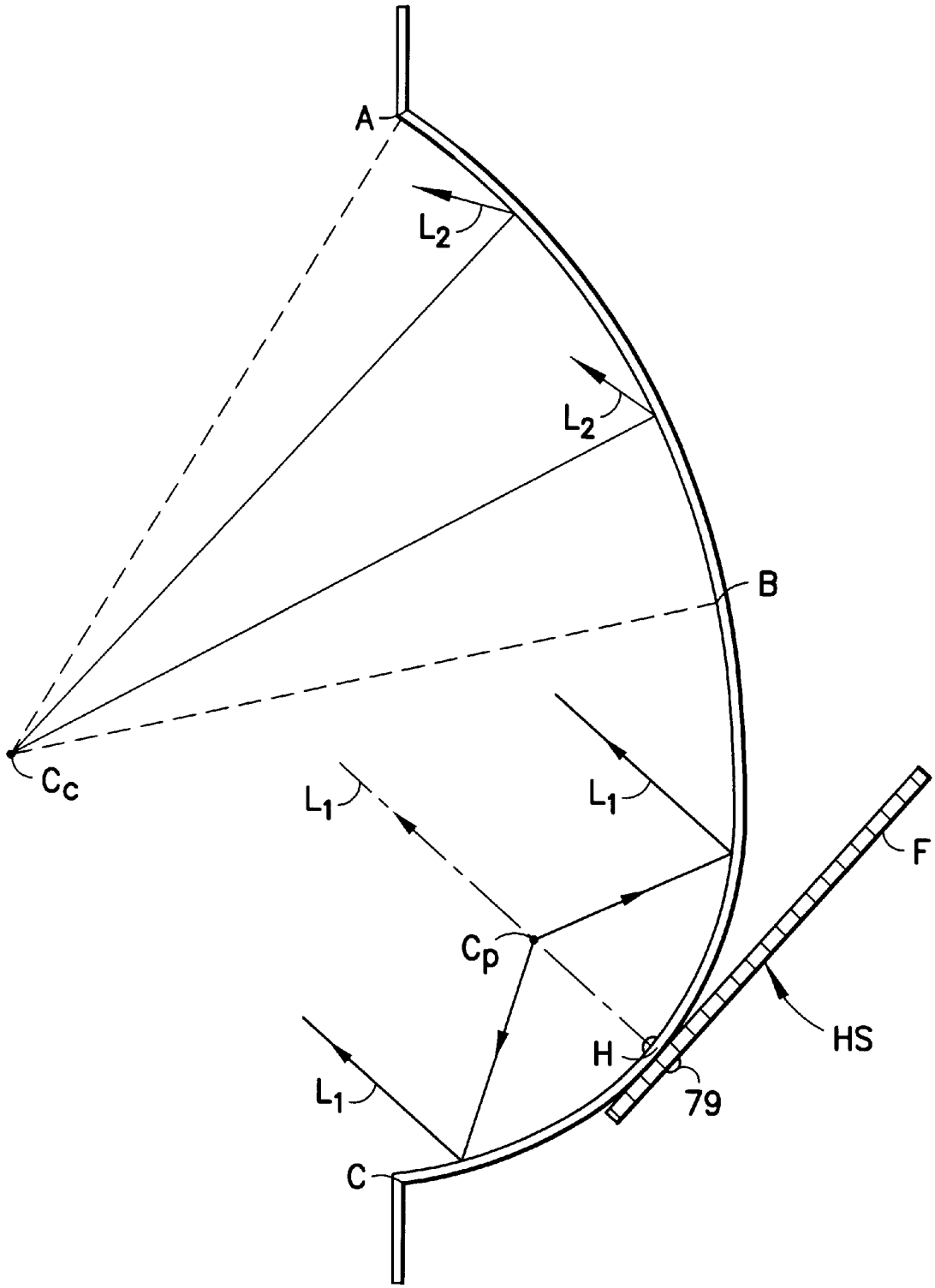
FIG. 2C is an enlarged side elevational of the reflector shown in FIG. 2, illustrating the component reflective surfaces making up the reflector and the location of the lamp or bulb in relation to such reflective surfaces.

Referring to FIG. 2C, the reflector R is formed of two separate and distinct portions. The upper portion between points A and B defines a sector of a circular cylinder having a center at $C_C$. The remaining lower portion of the reflector R between B and C is parabolic in cross section and has a focal point at the center point $C_P$. By placing the bulb or lamp B at the focal point $C_P$ of the parabolic portion, the light emanating from the lamp, treated as a point source and reflected from the parabolic portion, will be transmitted outwardly along substantially parallel directions ($L_1$) while the light reflected from the circular portion ($L_2$) will diverge at different angles, depending on the location of the circular portion from the central point $C_P$ of the lamp or bulb B.

Figure 2D:
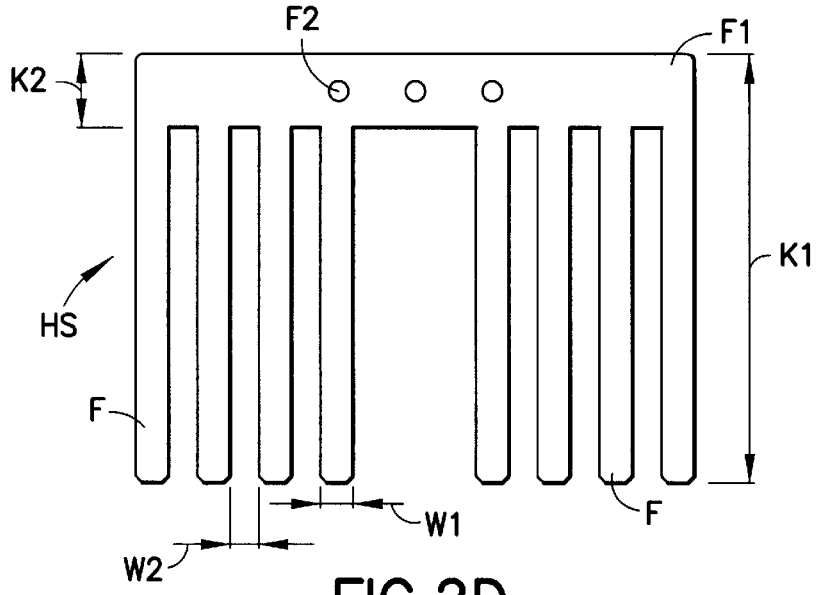
FIG. 2D is a top plan view of a heat sink mountable on the reflector.

As will also be seen in FIG. 2C, a suitable heat sink HS is attached to the rear of the metallic reflector R to dissipate the extensive heat from the lamp or bulb B which is close to the surface of the reflector. Since, it will be evident, the maximum heat will be developed at that point of the reflector closest to the central point $C_P$, suitable heat sinks, preferable in the form of projecting fingers F, can be attached to the metallic sheet material forming the reflector at the "hotspot" H (FIG. 2*c*) by any suitable means such as rivets 79. Such heat sinks or fingers F are shown in phantom outline in FIG. 2. While a plurality of equally spaced fingers F may be provided along the entire transverse width of the reflector R, it may be desired to omit one or more of such heat sink fingers F to avoid contact with components in back of the reflector R while the reflector is being rotated about its axis. Examples of obstructions in the back of the reflector include the linkage pin 76 and the adjusting plate 78. The fingers F may also be joined together as an integral heat sink HS, as shown in FIG. 2D, mounted on a transverse strip F1 provided with holes F2 for mounting the strip on the reflector R. The heat sink may be made of aluminum, the fingers typically having a width of approximately 0.25 in. and a spacing W2 of approximately 0.20 in. The height K of the heat sink may be approximately 3.00 in. while the height of the strip F1 may be approximately 0.50 in. Also, while eight fingers are shown in two groups of four, it will be evident that the shape and dimensions may be varied as required to provide the necessary heat dissipation while avoiding obstructions within the housing as the heat sink and the reflector are pivoted between extreme positions about the housing axis A.

In order to secure the flexible frame 26 to the housing 12, there is preferably provided a curved elongate alignment boss 64 on the interior surface of each side wall about which the frame 26 may be flexed. Thus, for example, once the lower frame portion 26 is positioned within the lower U-shaped retaining fingers 20*a*, 20*b* the frame may be flexed sufficiently to cause the upper frame portion 26*a* to be initially clear and received within the upper retaining fingers 18*a*, 18*b*. This will necessarily result in bending of the frame 26 to conform to the shape of the internal bosses 64, and the upper frame portion 26*a* will be securely received within the upper retaining fingers 18*a*, 18*b* as the frame is under stress when it is bent and it tries to revert to a flat planar condition.

Referring to FIG. 8, the line U is shown in phantom outline and represents the upper shadow line or upper cut line and a corresponding lower cut or lower shadow line L. These lines represent the maximum elevations directions beyond which the light cannot travel or project as a result of the obstructions caused by the U-shaped retainers as well as the baffles 22, 24. In FIG. 8, the reflector R is shown rotated about the lamp axis $A_L$ and the focal axis $A_F$ in a maximum clockwise rotated position, in which the knob 38 is in its lowermost position, which likewise moves the linkage pin 76 to its lower most position. Referring to FIG. 9, another position of the reflector R is illustrated in which the adjusting knob 38 has moved upwardly, as has the linkage pin 76, to cause the reflector follower plate 72, to rotate with the reflector R, in a counterclockwise direction about the lamp and reflector focal axes, $A_L$ and the focal axis $A_F$. It will be seen, therefore, that the focusing or adjustment of the distribution of the lamp intensity with this lamp is extremely simple, and is achieved without movement of the lamp itself, as the lamp simply rotates about its own axis. The same is true of the reflector R, which does not physically move linearly in any direction but merely rotates about the same axes about which the lamp rotates. The baffles 22*a*–22*c* and 24*a*–24*c* may be secured to the side walls 12*a*, 12*b* in any suitable manner, such as integral tabs 56, 60 fixed to the side walls by means of fasteners 58, 62, respectively, such as screws or rivets.

FIG. 10 is similar to FIG. 9 with the exception that instead of the flexible gel frame 26, a flat glass color filter 88 is shown which rests at its lower edge on the lower retaining fingers 20*a*, 20*b*, aligning the glass at its lateral edges along a straight preformed linear alignment boss 70, projecting inwardly from the inside surface of each side wall 12*a*, 12*b*, the upper edge of the glass color filter 88 being retained in any suitable manner. In FIG. 10, a color glass retaining clip 90 is provided which has an overlapping portion 90*a* that overlaps the glass color filter, a mounting portion 90*b* being secured to the baffle 22*a* by means of a suitable fastener such as a wing nut 92. The unique clip 90 safely secures stripped glass color filters to the housing 12.

Adjustable legs 84, 86 are advantageously provided at the front and the rear sides of the bottom wall 12*d* which are upwardly and downwardly independently adjustable to compensate for any elevational variations in the floor or surface upon which the CYC light is supported. By allowing the legs 84, 86 to be independently adjustable, it will be evident that the the CYC light may be adjusted to modify the orientation of the housing 12 while any such variations may be compensated, if desired, by repositioning of the reflector R. The independently adjustable feet eliminate the need for floor trunions or other objects for leveling the lamps when used in ground CYC applications. Preferably, three legs are provided—two rear legs 86 at the rear and one front leg 84 at the front of the bottom wall.

The operation of the CYC light 10 will now be described. Referring to FIG. 10, for example, a flat glass color filter 88 is placed with its lower edge within the lower retainer supports 20*a*, 20*b*, with the upper edge of the glass color filter being retained by the retaining clip 90 as described. The independently adjustable legs 84, 86 are adjusted to compensate for any leveling problems in the support surface that may be necessary, when used as a ground CYC or to focus the beam as desired. The light may now be focused by loosening the knob 38 and moving the shaft or post 38' within the slot 42 to rotate the reflector R about the lamp axis $A_L$. As indicated, because the lamp axis $A_L$ coincides with the focal axis $A_F$ of the parabolic portion of the reflector, rotation of the reflector does not modify the distribution of the projected rays but only changes the direction of emission. Therefore, once the housing position is adjusted to provide the desired distribution, such distribution is reliably maintained irrespective of the specific positions of the reflector.

Once the lamp or bulb B is energized, it will be evident that the air within the housing will become rapidly heated. To protect the user from injury as well as to protect the glass filter (or gel filter, when used) there is preferably provided a protective mesh screen S which covers the opening within the frame 53 of the reflector R. Once the air within the housing becomes heated it starts to rise and is forced through the constricted regions formed by the passages 22*d*, 22*e*. As indicated, the Venturi effect so formed creates a low pressure at the upper part of the housing which draws air both from the interior of the housing as well as air on the exterior of the housing. The resulting air flows are illustrated by the lines $f_1$–$f_4$ in FIG. 8. If desired, an additional internal baffle 80 may be provided as shown in FIGS. 8–10 with slots or other openings 82 provided within the bottom wall 12*d* below the an additional baffle, which causes additional air flow $f_5$ to be drawn into the housing 12 through region 24*g* and across the fingers F which form the heat sink. Such air flow additionally cools the heat sink and draws additional heat away from the reflector R making such reflector less susceptible to damage.

Figure 6:
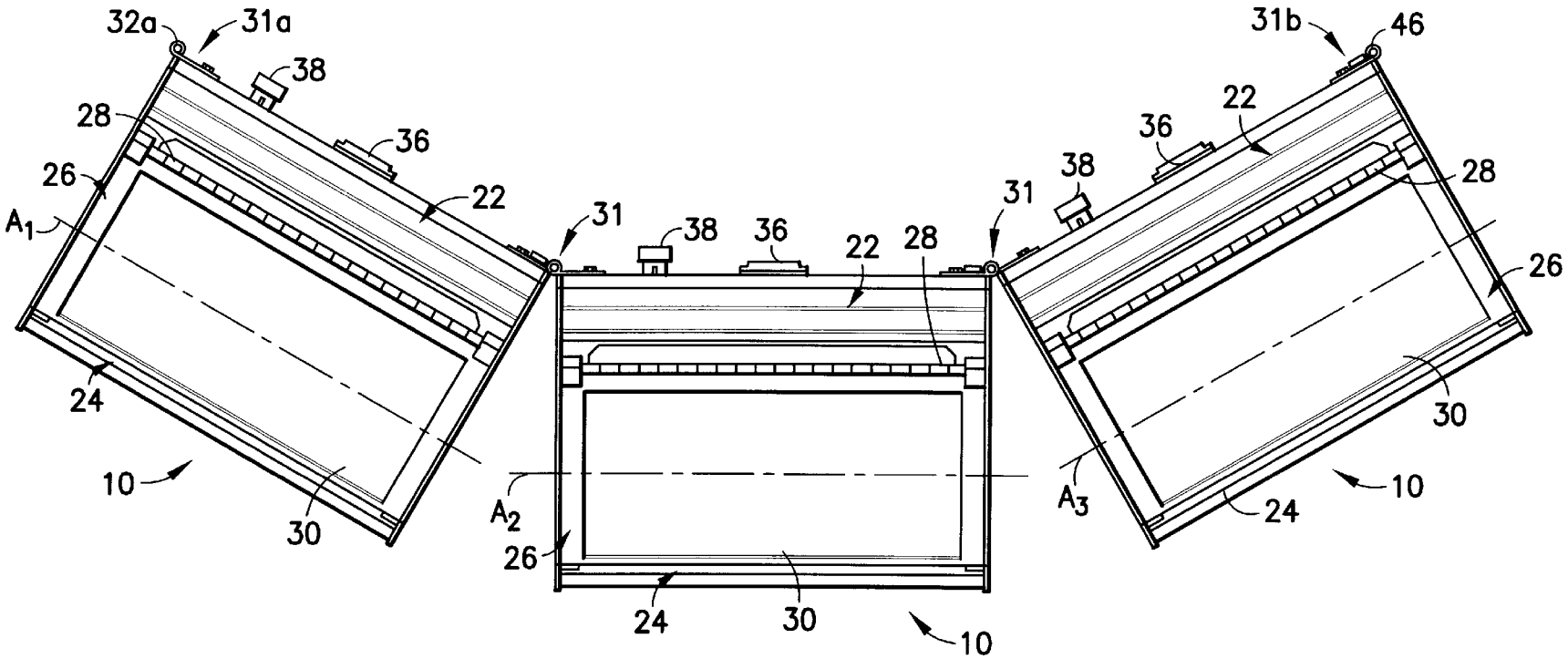
FIG. 6 is a top plan view of three CYC lights connected to each other and arranged along a curve in a horizontal plane for lighting a cyclorama curved in the horizontal plane.
Figure 7:
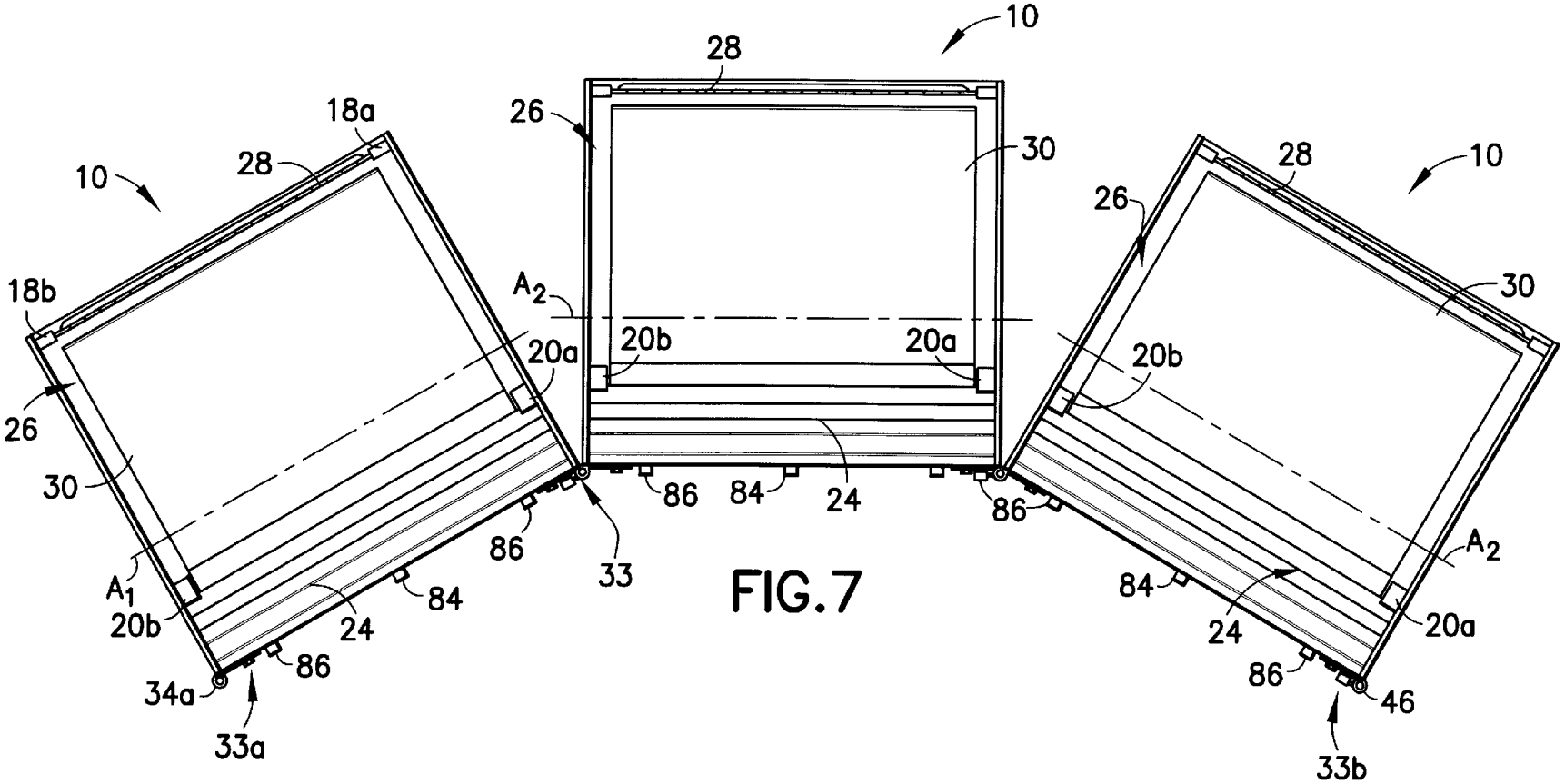
FIG. 7 is a front elevational view of three lights of the type shown in FIGS. 1–6 connected to each other along a curve in a vertical plane.

In FIG. 6 three CYC lights 10 in accordance with the invention are shown connected to each other along their rear lateral edges. Viewing these CYC lights in plan view it will be evident that these lights are arranged with their housing axes $A_1$ –$A_3$ along a line of curvature within a horizontal plane suitable for lighting a horizontally curved set or cyclorama. In FIG. 7 three CYC lights 10 are shown connected along their bottom edges and arranged with their housing axes $A_1$–$A_3$ along a line curved in a vertical plane. It will be evident that the quick release latches as suggested provide the user great flexibility for arranging or re-arranging the CYC lights in any desired configurations in a rapid and convenient manner.

Figure 11:
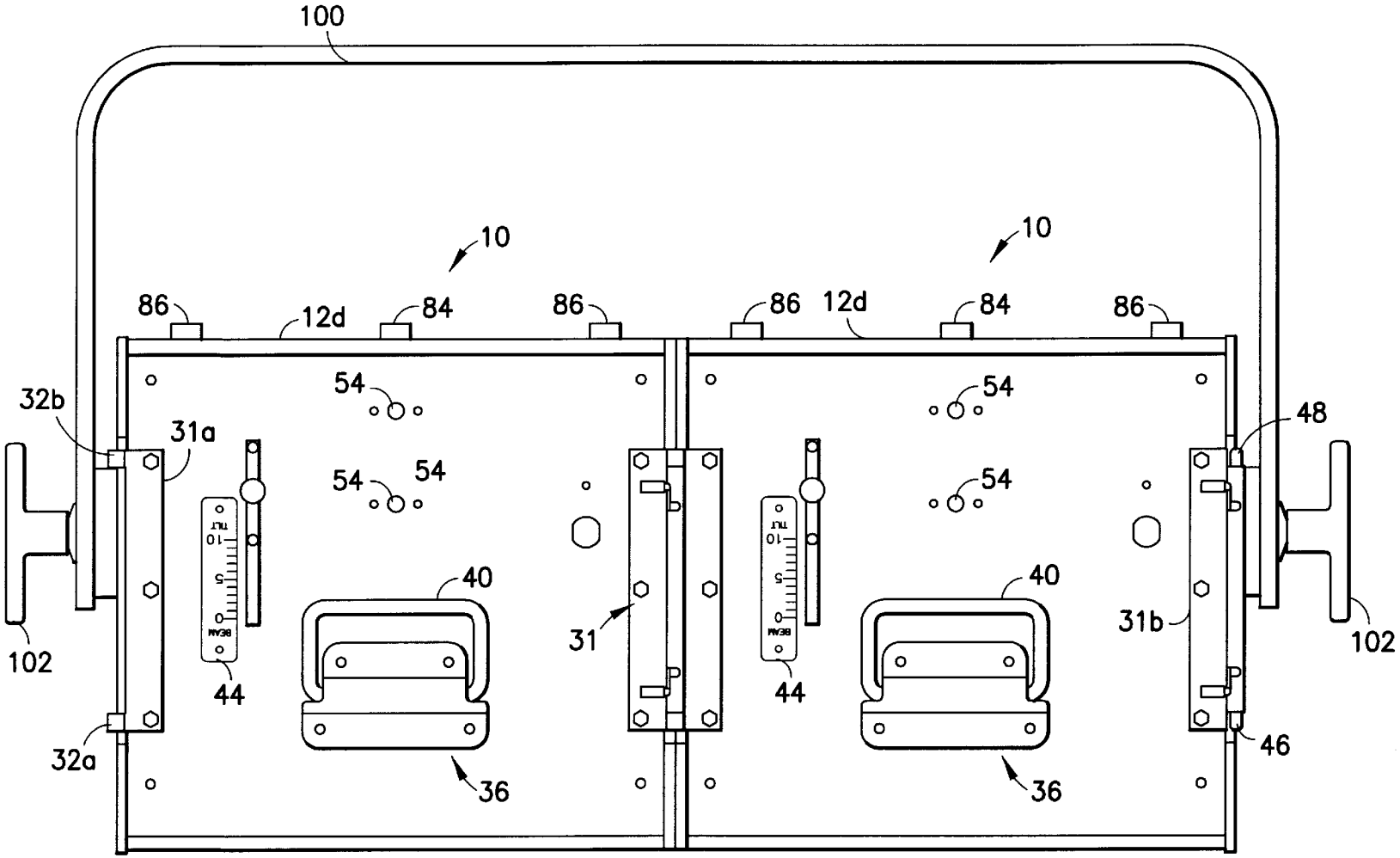
FIG. 11 is similar to FIG. 5 but showing the two connected CYC lights turned upside down or rotated 180° and secured by a yoke to mount the CYC lights in a sky position instead of a ground position.
Figure 12:
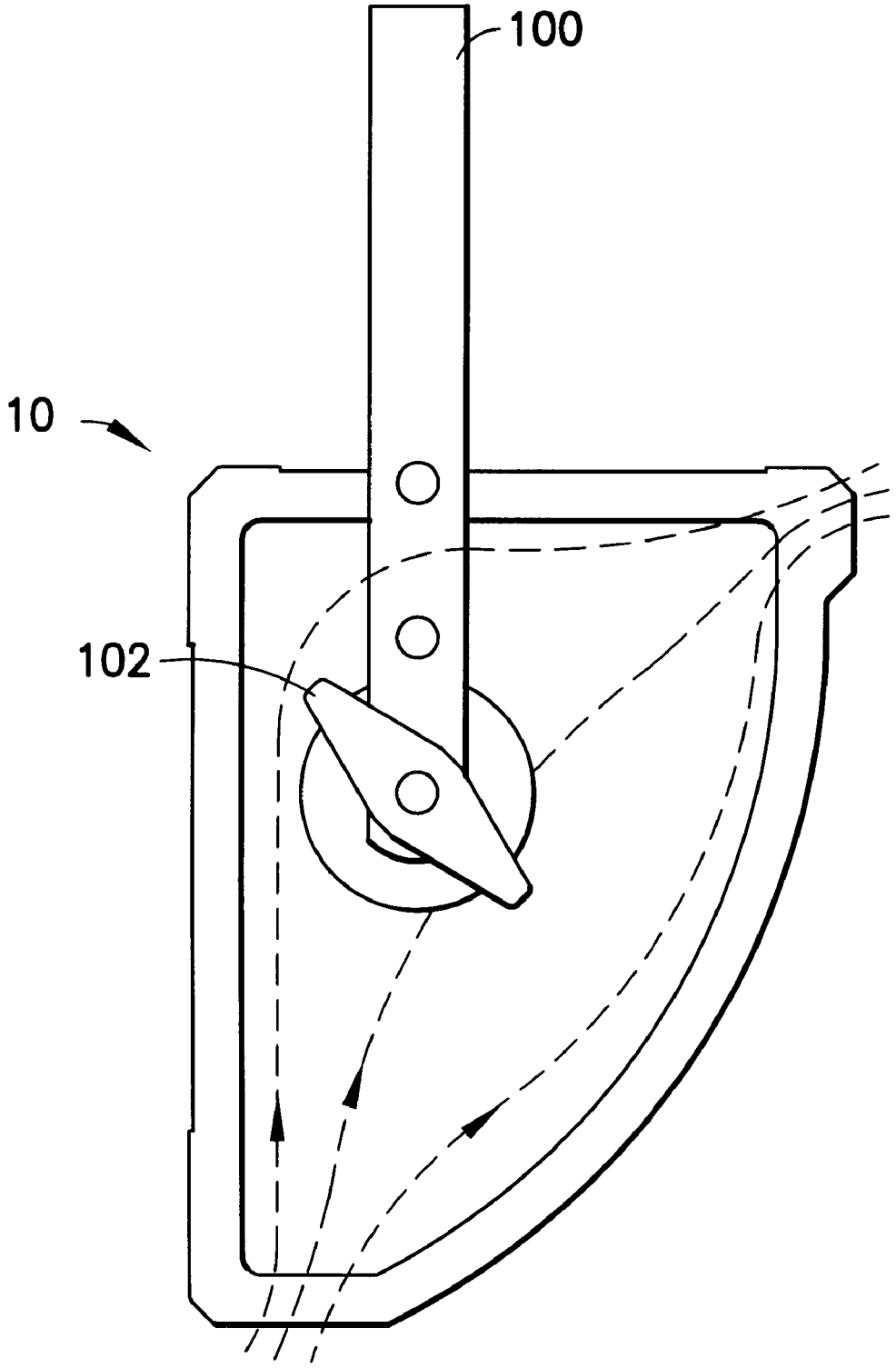
FIG. 12 is a side elevational view of the CYC lights shown in FIG. 11.

In FIG. 11, two CYC lights 10 are shown connected to each other by means of the spring loaded latches at their two adjoining side walls, a yoke 100 extending from the opposing side walls. Suitable knobs 102 are used to secure and tighten the yoke 100 to the side walls in any suitable manner. In the arrangement shown in FIG. 11, the two CYC lights are inverted or placed upside down from the positions shown in FIGS. 8–10 when used in a sky CYC position where the light is projected from an upper elevation substantially downwardly as opposed to the ground CYC position where the light projects from a lower elevation upwardly. FIG. 12 illustrates the positions of the CYC lights in FIG. 11, and also illustrates the manner in which the yoke 100 is attached to the bosses 14 in the side walls. FIG. 12 also suggests the air flows when the CYC lights are cooled in this orientation.

Figure 13:
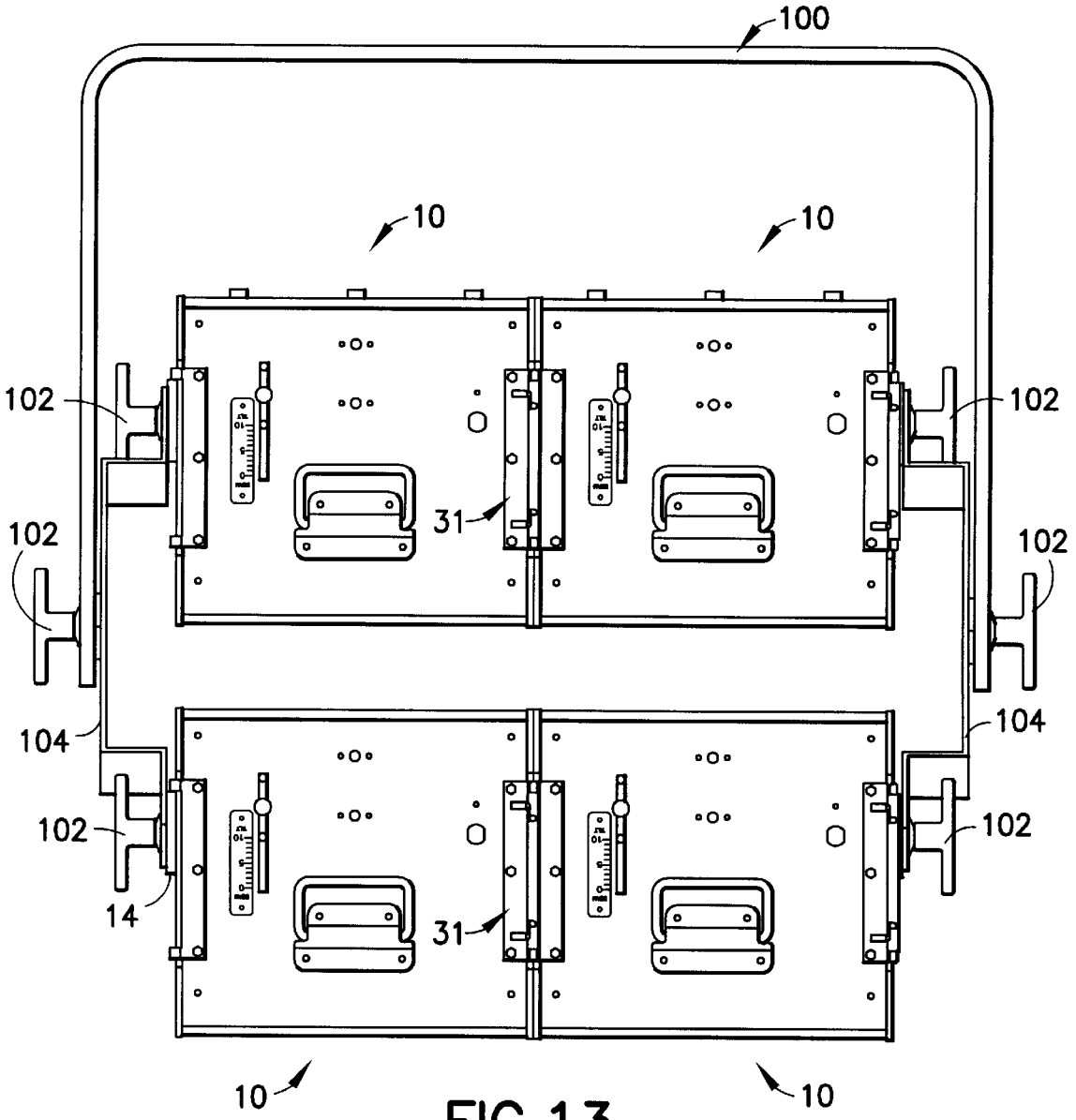
FIG. 13 is similar to FIG. 11, but showing two pairs of CYC lights spaced from each other by a bracket, with all four CYC lights supported by a common yoke connected to the brackets.
Figure 14:
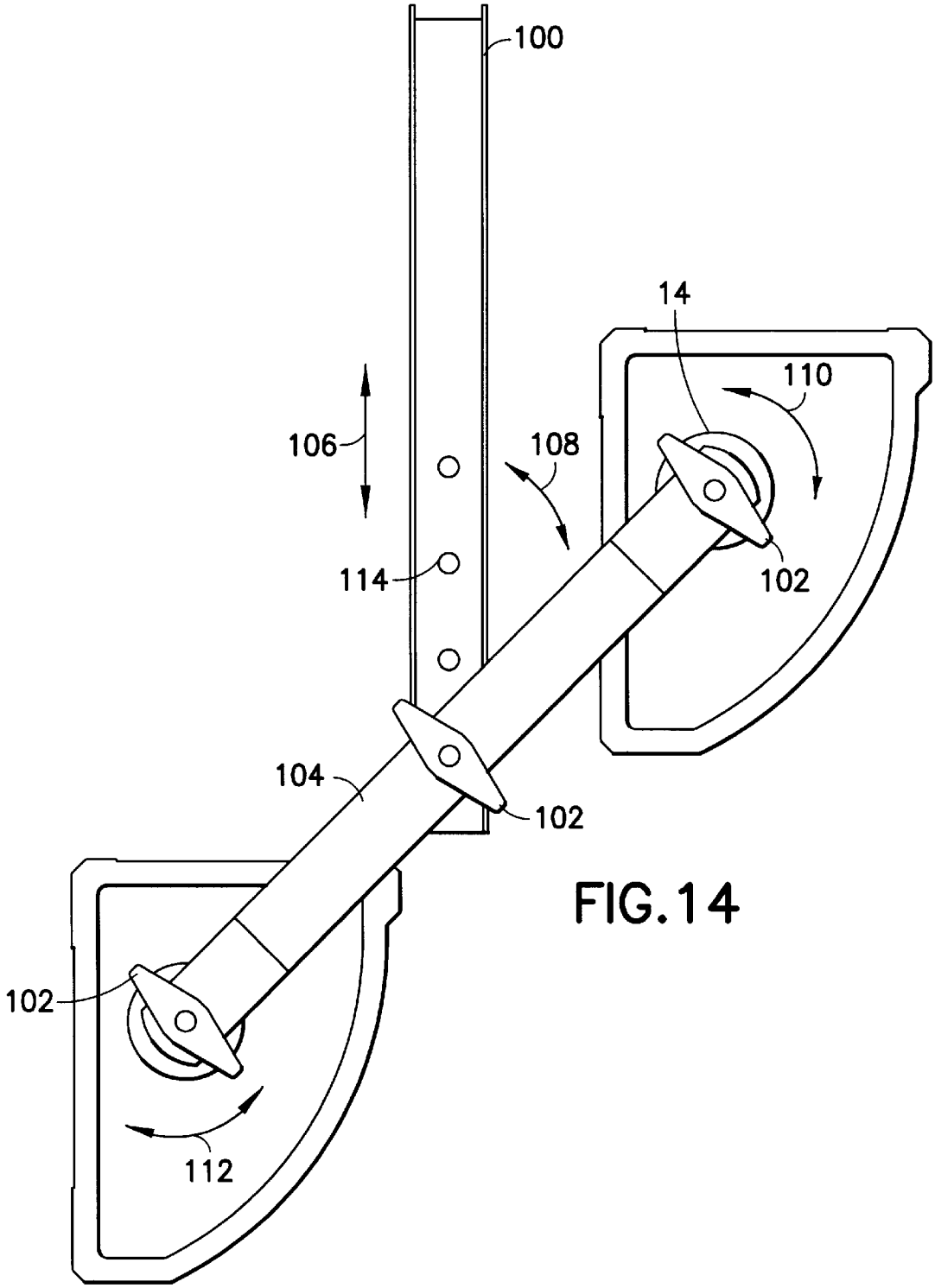
FIG. 14 is a side elevational view of the CYC lights shown in FIG. 13, illustrating the various degrees of adjustability for obtaining a desired light distribution in a sky CYC position.

In FIGS. 13 and 14, two banks of CYC lights are shown in which each pair of CYC lights is connected as shown in FIGS. 5 and 11, brackets 104 being used to connect each bank of two connected CYC lights to each other by means of knobsl02. The arrows 106,108, 110, 112 illustrate the wide range of adjustability that is available for positioning the CYC lights in numerous different positions relative to the set and to each other, when the yoke is provided with spaced adjustment apertures 114.

Figure 15:
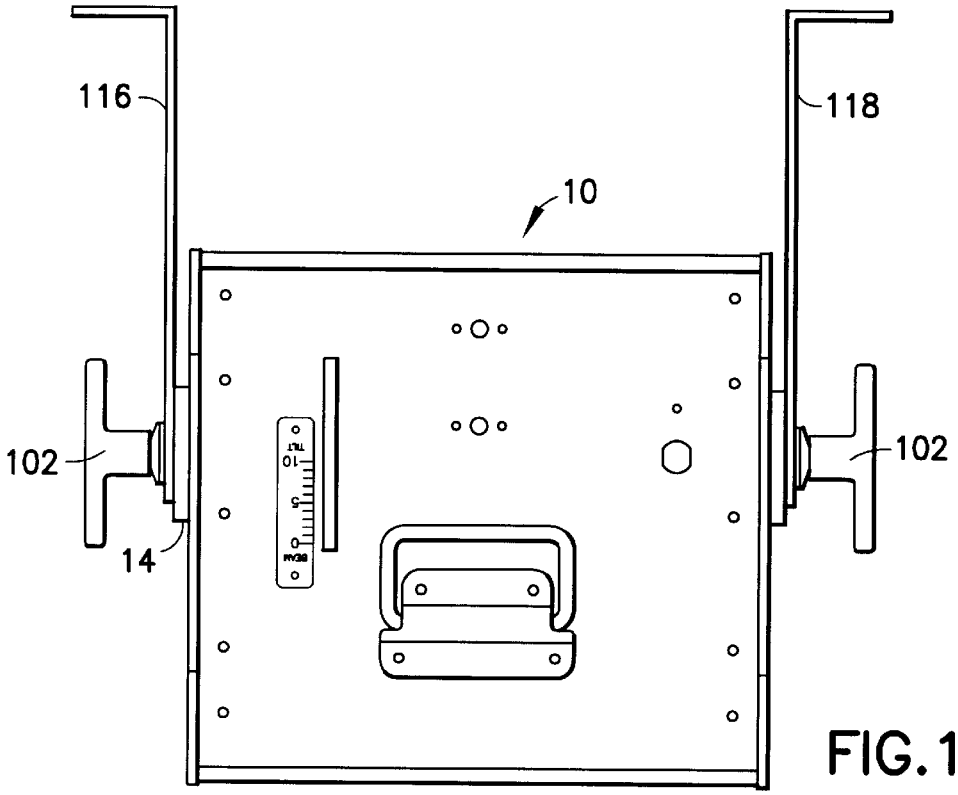
FIG. 15 is similar to FIG. 11, in which a CYC light in accordance with the invention is mounted in a sky CYC position, but supported by spaced lateral brackets instead of a yoke.
Figure 16:
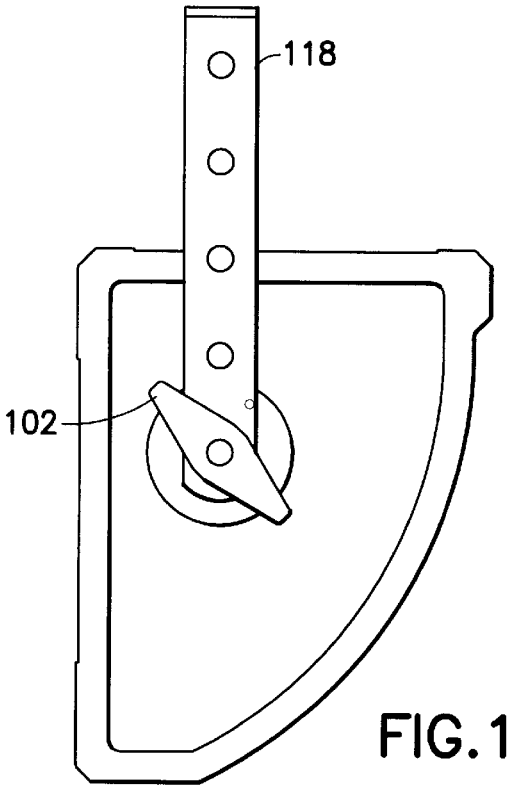
FIG. 16 is a side elevational view of the CYC light as mounted by the brackets shown in FIG. 15.

In FIGS. 15 and 16, different mounting hardware is shown, including side mounting brackets 116, 118 that are similarly connected to the side walls by means of knobs 102 that are threaded into the threaded hole 16 in the bosses 14 of the side walls as in the previous arrangements.

Figure 17:
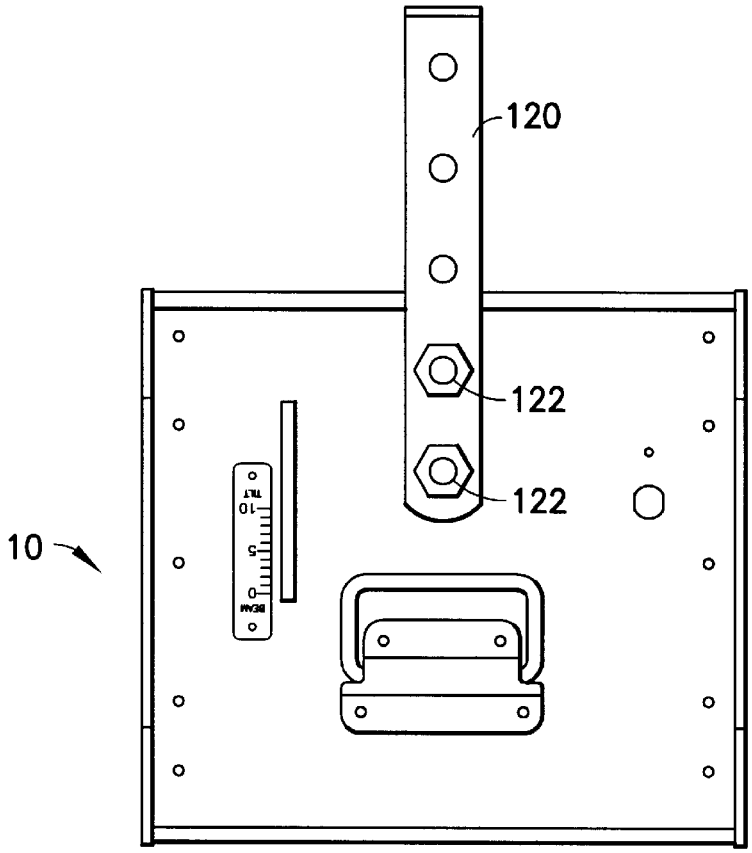
FIG. 17 is similar to FIG. 15, but showing different hardware for mounting the light of the present invention in a sky CYC position, in which a bracket is connected directly to the rear wall of the housing instead of the side walls as shown in FIG. 15.
Figure 18:
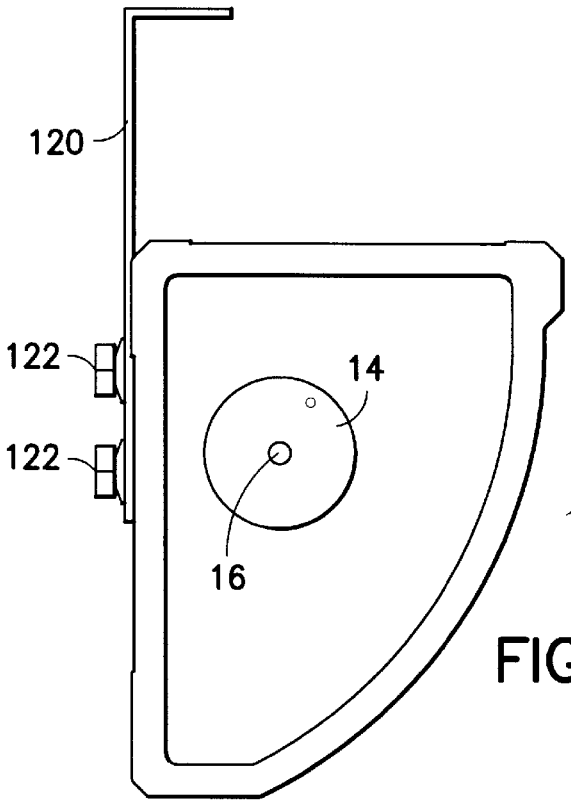
FIG. 18 is a side elevational view of the CYC light shown in FIG. 17.

In FIGS. 17 and 18, still additional mounting hardware is illustrated for mounting a CYC light in a sky CYC position in which a rear mounting bracket 120 is used and secured to the rear wall 12*c* by means of bolts 122 meshed with threaded holes 54 (FIG. 5). A wide selection of known yokes and other hanging hardware is also usable to accommodate additional sky CYC mounting configurations.

The housing 12 may be die-cast or sheet aluminum construction. The reflector R is preferably made of peened specular aluminum with integral or attached heat sync. Three height adjustable feet are preferably provided to allow for irregularities in the support surface when used as a ground CYC.

Figure 19:
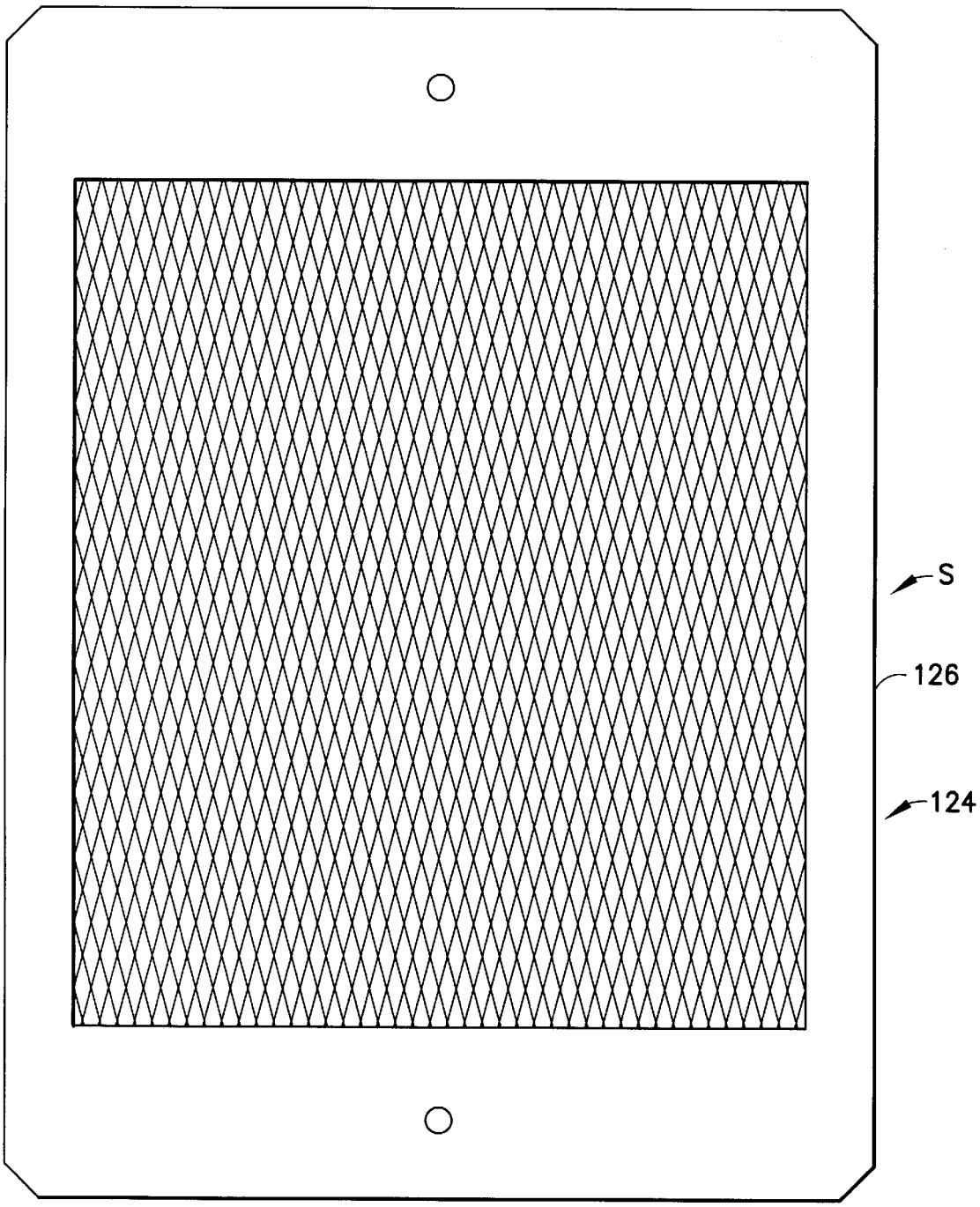
FIG. 19 is a front elevational view of a safety screen mounted on the front of the reflector that efficiently transmits the light emitted by the lamp while providing protection to the personnel using the light.

Referring to FIG. 19 the safety screen S is shown which includes a frame 124 adapted to be secured to the peripheral flanges of the reflector frame 53 to create a window for light transmission. A stainless steel expanded metal wire mesh screen 126 is placed across the open window of the screen. By selecting the dimensions of the cells of a mesh screen to provide a ratio of open area to obstructive area of at least 90%, transmission efficiencies of 90% or more can be achieved, so that with a 1000 watt lamp 900 watts of light energy are transmitted. This compares with approximately 70% efficiency with conventional protective wire screens. The super-thin safety screen is especially designed to allow optimal transmission of light but must also satisfy UL specifications and prevent passage of glass fragments of ⅛" diameter, so that the small diagonal of the diamond shaped openings cannot exceed ⅛". It has been found that a mesh in which the connecting webs, making up the diamond shaped openings, have a width of approximately 5 mm are suitable. Another benefit of using expanded metal is that the resulting webs or wires are arranged at an angle to the lamp axis $A_L$. This avoids noticeable shadows/lines that are frequently formed when the mesh or screen, such as woven wire screens, present wires parallel to the lamp axis.

With the configuration of the reflector R, the peak intensity is projected at an angle of approximately 45° from a horizontal reference, although such peak intensity may be focused upwardly or downwardly by the rotation of the reflector as described.

The CYC light of the present invention is, therefore, a light weight compact luminaire designed to provide an even wash of light on cycloramas and backdrops. It can also be used as a multi-purpose flood/fill light for stage and studio lighting applications. The CYC light is extremely versatile and efficient. The highly polished and peened reflector is arranged to pivot about the lamp axis $A_L$ for precision focusing. An adjustment knob, with an associated scale of markings, is located at the rear of the housing for adjusting and locking the reflector into position.

The light is extremely versatile and can easily replace a multitude of standard luminaires.

While this invention has been described in detail with particular reference to preferred embodiments thereof, it will be understood that variations and modifications will be effected within the spirit and scope of the invention as described herein and as defined in the appended claims.

What is claimed:

1. A cyclorama light (CYC) comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp optical having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; and adjustment means for selectively adjusting the rotational position of said reflector about said optical axis, whereby the direction of projection of the light emitted from said housing can be modified substantially independently of the specific orientation of said housing.

2. A cyclorama light (CYC) comprising a housing having generally opaque rear, bottom and side walls and an open front wall defining a window extending from a region proximate to the upper end of said rear wall and a region proximate to the front end of said bottom wall and generally ex tending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; adjustment means for selectively adjusting the rotational position of said reflector about said housing axis, said adjustment means comprising a slot in said rear wall extending along a direction substantially parallel to said side walls; a knob on the outside of said rear wall and having a shaft extending through said slot; and an adjusting bracket on the inside of said rear wall attached to said shaft for movement with said knob, said adjusting bracket being coupled to said reflector for imparting rotary movements to said reflector with movements of said knob along said slot, whereby the direction of projection of the light emitted from said housing can be modified substantially independently of the specific orientation of said housing.

3. A cyclorama light as defined in claim 2, wherein said adjusting bracket includes a transverse linkage pin, and a reflector follower plate attached to the rear of said reflector and provided with a slot for slidably receiving said linkage pin for coupling movements of said knob to said reflector.

4. A cyclorama light as defined in claim 1, further comprising connecting means for detachably connecting two housings of two lights to each other at associated side arranged in close proximity to each other.

5. A cyclorama light as defined in claim 1, wherein said reflector has a paracircular configuration including a first portion having a parabolic configuration arranged with the focal point of said parabolic portion substantially coincident with said housing axis and a second portion having a circular cylindrical portion having a center of curvature at a normal distance greater than the normal distance from said parabolic focal point to the reflecting surface of said reflector.

6. A cyclorama light as defined in claim 1, further comprising open baffles arranged between said rear wall and upper end of said window and between said bottom wall and lower end of said window to allow circulation of cooling air past said lamp, reflector and filter means to cool same.

7. A cyclorama light as defined in claim 1, wherein said elongate lamp is mechanically supported by a pair of electrical sockets or connectors spaced from each other along said housing axis, at least one of said sockets being mounted for movement along said housing axis to change the spacing between said electrical sockets or connectors to accommodate different length lamps.

8. A cyclorama light (CYC) comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; adjustment means for selectively adjusting the rotational position of said reflector about said housing axis, said filter means including a flexible filter frame having a width substantially equal to the width of said window and a predetermined height; and retaining means for resiliently retaining said flexible filter frame in a position to cover said window when flexed to impart curvature in a plane substantially parallel to said side walls to entirely cover said window, whereby the direction of projection of the light emitted from said housing can be modified substantially independently of the specific orientation of said housing.

9. A cyclorama light as defined in claim 1, further comprising heat sink means attached to said reflector for movements therewith about said housing axis for drawing heat away from said reflector and dissipating the same, whereby said heat sink means removes heat and cools said reflector independently of the position of said reflector.

10. A cyclorama light as defined in claim 1, further comprising screen means including a mesh material formed of filaments arranged to provide light transmitting openings, said filaments and openings having dimensions to provide at least 90% light transmission efficiency, whereby protection against injury is provided without excessively reducing the light output of the light.

11. A cyclorama light as defined in claim 1, further comprising attachment means attachable to at least one of said walls of said housing for mounting the light in a sky CYC position.

12. A cyclorama light as defined in claim 1, further comprising independently adjustable legs on said bottom wall for adjusting the orientation of the light when used as a ground CYC to compensate for an uneven or non-level floor or to shift the position(s) of shadow line(s) or cut(s).

13. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; and hinged connecting means for detachably and hingedly connecting two housings of two lights to each other at associated sides arranged in close proximity to each other.

14. A cyclorama light as defined in claim 13, wherein said connecting means comprises quick release latches on said side walls.

15. A cyclorama light as defined in claim 14, wherein at least one quick release latch is provided at each side wall proximate to said rear wall to allow a bank of lights to be arranged along a curved line in a horizontal plane.

16. A cyclorama light as defined in claim 14, wherein as least one quick release latch is provided at each side wall proximate to said bottom wall to allow a bank of lights to be arranged along a curved line in a vertical plane.

17. A cyclorama light as defined in claim 13, wherein said housing is provided with a female connecting member at one side wall and a male connecting member at the other side wall, whereby a plurality of housings can be coupled to each other to form a bank of lights.

18. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material, said reflector having a paracircular configuration including a first portion having a parabolic configuration arranged with the focal point of said parabolic portion substantially coincident with said housing axis and a second portion having a circular cylindrical portion having a center of curvature at a normal distance greater than the normal distance from said parabolic focal point to the reflecting surface of said reflector.

19. A cyclorama light as defined in claim 18, wherein said lamp is arranged with its elongate axis substantially coextensive with said focal point of said parabolic portion.

20. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; and open baffles arranged between said rear wall and upper end of said window and between said bottom wall and lower end of said window to allow convection flow of cooling air past said lamp, reflector and filter means to cool same.

21. A cyclorama light as defined in claim 20, wherein said baffles are configured to form Venturis that result in low pressure conditions on the exterior of said housing in the regions where heated air within said housing moves through said Venturis to create dynamic air flow through and about said housing to remove heat therefrom.

22. A cyclorama light as defined in claim 20, wherein said baffles are formed of a plurality of transverse members of sheet material spaced from each other and from the upper end of said rear wall and a plurality of transverse members of sheet material spaced from each other and from the forward end of said bottom wall.

23. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material, said elongate lamp being mechanically supported by a pair of electrical sockets or connectors spaced from each other along said housing axis, at least one of said sockets being mounted for movement along said housing axis to b e fixed in one of a plurality of selected positions to change the spacing between said electrical sockets or connectors to accommodate different length lamps.

24. A cyclorama light as defined in claim 23, wherein said at least one of said sockets is mounted for movement to preselected positions to define preselected spacings between said sockets to accommodate standard lamp sizes.

25. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material and including a flexible filter frame having a width substantially equal to the width of said window and a predetermined height; and retaining means for resiliently retaining said flexible filter frame in a position to cover said window when flexed to impart a curvature in a plane substantially parallel to said side walls to entirely cover said window.

26. A cyclorama light as defined in claim 25, wherein said retaining means comprises a pair of upper U-shaped retaining fingers at the upper ends of said window and a pair of lower U-shaped retaining fingers at the lower end of said window, said upper and lower positioned fingers being linearly spaced from each other a distance less than the height of said flexible filter frame, said upper and lower retaining fingers being oriented to receive the upper and lower ends of said flexible filter frame when flexed and mounted on said housing.

27. A cyclorama light as defined in claim 25, further comprising arcuate positioning means projecting inwardly from each side wall for positioning said flexible frame in a desired flexed condition.

28. A cyclorama light as defined in claim 27, wherein said positioning means comprises elongate curved bosses.

29. A cyclorama light as defined in claim 26, further comprising straight bosses on the interior surfaces of said side walls for aligning an optional flat glass color filter supported on said pair of lower U-shaped retaining fingers; and further comprising a retaining clip including a first portion for engaging the upper edge of the flat glass color filter and a second portion attachable to said housing.

30. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; and heat sink means directly attached to said reflector for movements therewith about said housing axis for drawing heat away from said reflector and dissipating the same, whereby said heat sink means removes heat and cools said reflector independently of the position of said reflector.

31. A cyclorama light as defined in claim 30, wherein said heat sink means comprises a plurality of spaced elongate substantially parallel fingers attached to the rear of said reflector.

32. A cyclorama light as defined in claim 31, wherein said fingers are attached at a point tangent to said reflector along a line substantially parallel to said housing axis.

33. A cyclorama light as defined in claim 32, wherein said tangent line substantially coincides with points along said reflector closest to said lamp corresponding to the hot spots on said reflector.

34. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; and screen means mounted between said reflector and said window for preventing injury when said lamp shatters, said screen means including a mesh material formed of filaments rranged to provide light transmitting openings, said filaments and openings having dimensions to provide at least 90% light transmission efficiency, whereby protection against injury is provided without excessively reducing the light output of the light.

35. A cyclorama light as defined in claim 34, wherein said screen mesh material is formed of stainless steed expanded metal wire mesh.

36. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; and attachment means attachable to at least one of said walls of said housing for mounting the light in a sky position.

37. A cyclorama light as defined in claim 36, wherein said attachment means comprises a yoke attachable to said side walls.

38. A cyclorama light as defined in claim 36, wherein said attachment means comporises brackets attachable to said side walls.

39. A cyclorama light as defined in claim 36, wherein said attachment means comprises a bracket attachable to said rear wall.

40. A cyclorama light as defined in claim 36, wherein said attachment means comprises a yoke attachable to a bank of CYC lights secured side by side to each other along a straight line.

41. A cyclorama light comprising a housing having generally opaque rear, bottom and side walls and an open front wall defining a window extending from a region proximate to the upper end of said rear wall and a region proximate to the front end of said bottom wall and generally extending between said side walls, said housing defining a housing axis generally parallel to said rear and bottom walls and normal to said side walls; an elongate reflector essentially extending between said side walls and mounted for rotary movements about said housing axis; an elongate lamp having a lamp axis and mounted on said reflector to maintain said lamp axis substantially coextensively with said housing axis, said reflector being configured to direct light generated by said elongate lamp with a predetermined intensity distribution through said window formed in said open front wall in a direction which is a function of the rotational position of said reflector about said housing axis; filter means for covering said window with a color filter material; and at least three independently adjustable legs on said bottom wall for adjusting the orientation of the light when used as a ground CYC to compensate for an uneven or non-level floor or to shift the position(s) of shadow line(s).

42. A cyclorama light as defined in claim 41, wherein three legs are provided.

* * * * *